US007402380B2

(12) United States Patent
Fukui

(10) Patent No.: US 7,402,380 B2
(45) **Date of Patent: *Jul. 22, 2008**

(54) PHOTOTHERMOGRAPHIC MATERIAL

(75) Inventor: Kouta Fukui, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/338,785

(22) Filed: Jan. 25, 2006

(65) Prior Publication Data

US 2006/0172234 A1 Aug. 3, 2006

(30) Foreign Application Priority Data

Jan. 28, 2005 (JP) ..... 2005-022108

(51) Int. Cl.
*G03C 1/498* (2006.01)
*G03C 1/42* (2006.01)

(52) U.S. Cl. ..... 430/619; 430/517; 430/531; 430/607

(58) Field of Classification Search ..... 430/619, 430/531, 517, 607, 529
See application file for complete search history.

(56) References Cited

U.S. PATENT DOCUMENTS

| | | | | |
|---|---|---|---|---|
| 6,727,057 | B2 * | 4/2004 | Suzuki et al. | 430/619 |
| 7,153,646 | B2 * | 12/2006 | Fukui et al. | 430/617 |
| 2002/0058220 | A1 * | 5/2002 | Tsukada et al. | 430/620 |
| 2006/0115776 | A1 * | 6/2006 | Fukui et al. | 430/619 |

FOREIGN PATENT DOCUMENTS

JP 2000112072 * 4/2000

* cited by examiner

*Primary Examiner*—Thorl Chea
(74) *Attorney, Agent, or Firm*—Margaret A. Burke; Sheldon J. Moss

(57) ABSTRACT

A photothermographic material having, on at least one side of a support, an image forming layer including at least a photosensitive silver halide, a non-photosensitive organic silver salt, a reducing agent, and a binder, wherein 1) the binder includes a polymer latex having a monomer component represented by formula (M):

$$CH_2{=}CR^{01}{-}CR^{02}{=}CH_2 \qquad \text{Formula (M)}$$

2) the photothermographic material includes a compound represented by formula (SA):

Formula (SA)

and 3) the photothermographic material further includes a metal phthalocyanine dye represented by formula (PC-1):

Formula (PC-1)

wherein at least one of $R^1$, $R^4$, $R^5$, $R^8$, $R^9$, $R^{12}$, $R^{13}$, and $R^{16}$ is an electron-attracting group. The invention provides a photothermographic material which produces an image free from unevenness in color tone, having high image quality, and is excellent in image storability.

9 Claims, No Drawings

PHOTOTHERMOGRAPHIC MATERIAL

CROSS-REFERENCE TO RELATED APPLICATION

This application claims priority under 35 USC 119 from Japanese Patent Application No. 2005-022108, the disclosure of which is incorporated by reference herein.

BACKGROUND OF THE INVENTION

1. Field of the Invention

The present invention relates to a photothermographic material preferably used in the field of films for medical diagnosis, the field of films for graphic arts, or the like.

2. Description of the Related Art

In recent years, in the medical field and the graphic arts field, there has been a strong desire for providing a dry photographic process from the viewpoints of protecting the environment and economy of space. Further, the development of digitization in these fields has resulted in the rapid development of systems in which image information is captured and stored in a computer, and then when necessary processed and output by transmitting it to a desired location. Here the image information is output onto a photosensitive material using a laser image setter or a laser imager, and developed to form an image at the location. It is necessary for the photosensitive material to be able to record an image with high-intensity laser exposure and that a clear black-tone image with a high resolution and sharpness can be formed. While various kinds of hard copy systems using pigments or dyes, such as ink-jet printers or electrophotographic systems, have been distributed as general image forming systems using such digital imaging recording materials, images on the digital imaging recording materials obtained by such general image forming systems are insufficient in terms of the image quality (sharpness, granularity, gradation, and tone) needed for medical images used in making diagnoses, and high recording speeds (sensitivity). These kinds of digital imaging recording materials have not reached a level at which they can replace medical silver halide film processed with conventional wet development.

Photothermographic materials utilizing organic silver salts are already known. Photothermographic materials have an image forming layer in which a reducible silver salt (for example, an organic silver salt), a photosensitive silver halide, and if necessary, a toner for controlling the color tone of developed silver images are dispersed in a binder.

Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. Photothermographic materials have been described in many documents, and the Fuji Medical Dry Imager FM-DPL is an example of a practical medical image forming system using a photothermographic material that has been marketed.

These photothermographic materials utilizing an organic silver salt have a great characteristic of containing all components necessary for image formation in the film in advance and being capable of forming images only by heating. However, on the other hand, there are many problems to be solved.

Photothermographic materials do not require the processing solutions used in conventional wet processing in the case of silver halide photosensitive materials, and have an advantage in that processing can be carried out easily and rapidly. However, there are still problems to be solved with respect to photothermographic materials, which do not occur in conventional wet processing in the case of silver halide photosensitive materials. One of them is the problem of decolorization of dyes. Silver halide photosensitive materials commonly incorporate dyes in order to provide a light filter and prevent halation or irradiation therein. The added dyes function during imagewise exposure. In the case where the dyes have a spectral light absorption in the visible region, if the dyes remain in a photosensitive material after performing their function, the formed images may be colored by the dyes, and image quality may be damaged. Therefore the residual dyes are preferably removed from the photosensitive materials during the developing process. In a wet developing process, the residual dyes can be removed easily from the photosensitive materials by a processing solution. On the other hand, in the case of the photothermographic material, it is a significant task to remove the residual dyes.

More specifically, in order to attain images with a good degree of sharpness, the incorporation of dyes is very important for photothermographic materials exposed by a laser beam to provide sufficient antihalation and anti-irradiation effects at the wavelength used for the imagewise exposure. As for the wavelength of a laser beam used for the exposure, a wide range of wavelength regions such as the near infrared region, the infrared region, or the visible region from red to blue can be applied.

For photothermographic materials exposed with either a near infrared or an infrared laser beam, Japanese Patent Application Laid-Open (JP-A) Nos. 9-146220 and 11-228698 disclose photothermographic materials which practically require no color bleaching mechanism therein due to use of a dye which has an absorption maximum within the near infrared regions outside of visual sensitivity, a narrow half band width, and little light absorption within the visual region. All patents, patent publications, and non-patent literature cited in this specification are hereby expressly incorporated by reference herein.

For photothermographic materials which are subjected to imagewise exposure with a laser beam having a wavelength within the visible region of blue to red, it is preferable to incorporate some kind of decoloring reaction mechanism.

A method for decoloring dyes by way of heating during a thermal developing process has been proposed. For example, U.S. Pat. No. 5,135,842 discloses a method for decoloring polymethine dyes of a specific structure by heating. Moreover, U.S. Pat. Nos. 5,314,795, 5,324,627, and 5,384,237 disclose methods in which polymethine dyes are decolorized by heating using a carbanion generating agent.

However, the decoloring mechanisms described above often bring about problems such as incomplete decoloring of dyes or dye decolorization during storage of photothermographic materials due to the insufficient stability of dye occurring after bleaching ability has been enhanced. Especially, in photothermographic materials used in medical diagnosis, high sharpness and preferable image tone are required. Furthermore, demand has increased for image forming methods used for processing photothermographic materials rapidly at a higher speed within a short time. Particularly in uses for medical treatment, there is a strong desire for rapid diagnosis.

SUMMARY OF THE INVENTION

An aspect of the invention is to provide a photothermographic material comprising, on at least one side of a support, an image forming layer comprising at least a photosensitive silver halide, a non-photosensitive organic silver salt, a reducing agent, and a binder, wherein (1) the binder comprises a polymer latex having a monomer component represented by the following formula (M):

$$CH_2{=}CR^{01}{-}CR^{02}{=}CH_2 \qquad \text{Formula (M)}$$

wherein $R^{01}$ and $R^{02}$ each independently represent one selected from a hydrogen atom, an alkyl group having 1 to 6 carbon atoms, a halogen atom, or a cyano group; and $R^{01}$ and $R^{02}$ are not simultaneously a hydrogen atom;

(2) the photothermographic material comprises a compound represented by the following formula (SA):

Formula (SA)

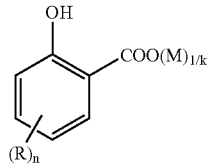

wherein M represents a hydrogen atom or a cation having a valency of k; R represents a substituent; n represents an integer of from 1 to 4; when n is 2 or more, a plurality of R may be the same or different from one another; k represents an integer of 1 or more; and when M is a hydrogen atom, k is 1; and (3) the photothermographic material further comprises a metal phthalocyanine dye represented by formula (PC-1):

Formula (PC-1)

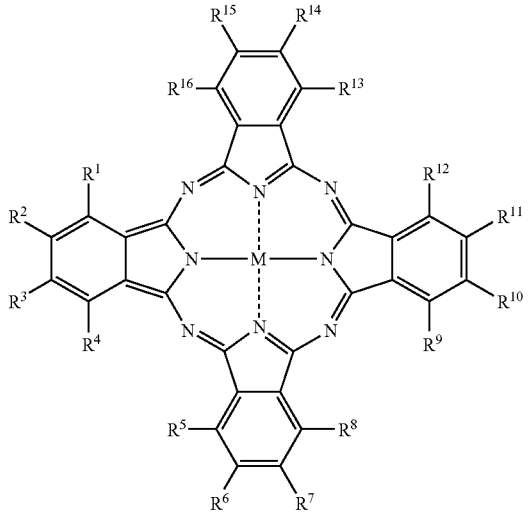

wherein, M represents a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is an electron-attracting group; and $R^2$, $R^2$, $R^3$, $R^6$, $R^7$, $R^{10}$, $R^{11}$, and $R^{15}$ each independently represent a hydrogen atom or a substituent.

DETAILED DESCRIPTION OF THE INVENTION

An object of the present invention is to provide a photothermographic material which exhibits high sharpness, preferable image tone, and excellent image storability.

The inventors aimed to realize a photothermographic material that produces images with a high degree of sharpness and preferable image tone and searched for a solution and means of improvement for the causes of worsening of uneven image quality, and especially uneven image tone. As a result, the inventors found that the selection of a polymer binder having a specific structure, the use of salicylic acid derivatives having a specific structure, and the use of a metal phthalocyanine compound having a specific structure is effective in improving image color tone, uneven image density, and image stability with respect to light, whereby they arrived at the present invention disclosed in claim 1. Further search for more preferred constituent conditions led to the invention disclosed in claim 2 to claim 8.

The present invention is especially effective for forming an image by rapid thermal development processing in uses for the medical field.

The present invention is explained below in detail.

The photothermographic material of the present invention has, on at least one side of a support, an image forming layer containing at least a photosensitive silver halide, a non-photosensitive organic silver salt, a reducing agent, and a binder. The photothermographic material may further have a non-photosensitive layer such as a surface protective layer or an intermediate layer between the image forming layer and the surface protective layer, when necessary. The surface protective layer may be a single layer or plural layers. Further, the photothermographic material may have a back layer or a back surface protective layer on the opposite side of the support from the image forming layer.

(Binder for Image Forming Layer)

In the present invention, the binder of the image forming layer contains a polymer latex having a monomer component represented by the following formula (M).

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl group having 1 to 6 carbon atoms, a halogen atom, or a cyano group. However, $R^{01}$ and $R^{02}$ are not simultaneously a hydrogen atom.

As an alkyl group for $R^{01}$ or $R^{02}$, an alkyl group having one to four carbon atoms is preferred, and more preferred is an alkyl group having one or two carbon atoms. As a halogen atom for $R^{01}$ or $R^{02}$, a fluorine atom, a chlorine atom, and a bromine atom are preferred, and more preferred is a chlorine atom.

Particularly preferably, one of $R^{01}$ or $R^{02}$ is a hydrogen atom and the other is a methyl group or a chlorine atom. More preferably, one of $R^{01}$ or $R^{02}$ is a hydrogen atom and the other is a methyl group.

Specific examples of the monomer represented by formula (M) of the present invention include 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro-1,3-butadiene, 2,3-dichloro-1,3-butadiene, and 2-cyano-1,3-butadiene.

The binder of the present invention is a polymer obtained by copolymerizing the monomer represented by formula (M), where the copolymerization ratio of the monomer represented by formula (M) for the polymer is in a range of from 10% by weight to 70% by weight, preferably from 15% by weight to 65% by weight, and more preferably from 20% by weight to 60% by weight. When the copolymerization ratio of the monomer represented by formula (M) is lower than 10% by weight, bonding component of the binder is decreased and manufacturing-related brittleness is deteriorated. When the copolymerization ratio of the monomer represented by formula (M) exceeds 70% by weight, bonding component of the binder is increased and mobility of the binder is increased, and as a result, image storability is deteriorated.

In the invention, the other monomers, which are capable to copolymerize with the monomer represented by formula (M), are not particularly restricted, and any monomers may be preferably used provided that they can polymerize by usual radical polymerization or ion polymerization. As the monomer which can be used preferably, it is capable to select the combination independently and freely from the monomer groups (a) to (j) described below.

Monomer Groups (a) to (j)

(a) conjugated dienes: 1,3-butadiene, 1,3-pentadiene, 1-phenyl-1,3-butadiene, 1-α-naphthyl-1,3-butadiene, 1-β-naphthyl-1,3-butadiene, 1'-bromo-1,3-butadiene, 1-chloro-1,3-butadiene, 1,1,2-trichloro-1,3-butadiene, cyclopentadiene, and the like;

(b) olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, and the like;

(c) α,β-unsaturated carboxylic acid and salts thereof: acrylic acid, methacrylic acid, itaconic acid, maleic acid, sodium acrylate, ammonium methacrylate, potassium itaconate, and the like;

(d) α,β-unsaturated carboxylate esters: alkyl acrylate (for example, methyl acrylate, ethyl acrylate, butyl acrylate, cyclohexyl acrylate, 2-ethylhexyl acrylate, dodecyl acrylate, and the like), substituted alkyl acrylate (for example, 2-chloroethyl acrylate, benzyl acrylate, 2-cyanoethyl acrylate, and the like), alkyl methacrylate (for example, methyl methacrylate, butyl methacrylate, 2-ethylhexyl methacrylate, dodecyl methacrylate, and the like), substituted alkyl methacrylate (for example, 2-hydroxyethyl methacrylate, glycidyl methacrylate, glycerine monomethacrylate, 2-acetoxyethyl methacrylate, tetrahydrofurfulyl methacrylate, 2-methoxyethyl methacrylate, polypropyleneglycol monomethacrylate (addition mole number of polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, 2-isocyanatoethyl methacrylate, and the like), derivatives of unsaturated dicarboxylic acid (for example, monobutyl maleate, dimethyl maleate, monomethyl itaconate, dibutyl itaconate, and the like), and polyfunctional esters (for example, ethyleneglycol diacrylate, ethyleneglycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, 1,2,4-cyclohexane tetramethacrylate, and the like);

(e) amides of β-unsaturated carboxylic acid: for example, acrylamide, methacrylamide, N-methylacrylamide, N,N-dimethylacrylamide, N-methyl-N-hydroxyethyl methacrylamide, N-tert-butyl acrylamide, N-tert-octyl methacrylamide, N-cyclohexyl acrylamide, N-phenyl acrylamide, N-(2-acetoacetoxyethyl) acrylamide, N-acryloyl morpholine, diacetone acrylamide, diamide itaconate, N-methyl maleimide, 2-acrylamide-methylpropanesulfonic acid, methylenebis acrylamide, dimethacryloyl piperazine, and the like;

(f) unsaturated nitriles: acrylonitrile, methacrylonitrile, and the like;

(g) styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, and the like;

(h) vinylethers: methylvinyl ether, butylvinyl ether, methoxyethylvinyl ether, and the like;

(i) vinyl esters: vinyl acetate, vinyl propionate, vinyl benzoate, vinyl salicylate, vinyl chloroacetate, and the like; and (j) other polymerizable monomers: N-vinylimidazole, 4-vinylpyridine, N-vinylpyrrolidone, 2-vinyloxazoline, 2-isopropenylozazoline, divinylsulfone, and the like.

Preferred examples of a polymer copolymerized with the monomer represented by formula (M) of the present invention include copolymers with styrene (for example, random copolymer, block polymer, or the like), copolymers with styrene and butadiene (for example, random copolymer, butadiene-isoprene-styrene block copolymer, styrene-butadiene-isoprene-styrene block copolymer, or the like), copolymers with ethylene and propylene, copolymers with acrylonitrile, copolymers with isobutyrene, copolymers with acrylic esters (for example, as acrylic ester, ethyl acrylate, butyl acrylate, or the like can be used), and copolymers with acrylic ester and acrylonitrile (the same acrylic esters as mentioned above can be used). Among these, most preferred is a copolymer with styrene.

In addition to the above components, the polymer of the present invention is preferably further copolymerized with a monomer having an acid group. As the acid group, preferred are a carboxylic acid, a sulfonic acid, and a phosphoric acid. The copolymerization ratio of a monomer having the acid group is preferably from 1% by weight to 20% by weight, and more preferably from 1% by weight to 10% by weight.

Examples of a monomer having the acid group include acrylic acid, methacrylic acid, itaconic acid, p-styrene sulfonic acid sodium salt, isopyrene sulfonic acid, phoshoryl ethyl methacrylate, and the like.

Any kind of polymer may be used in combination with the polymer obtained by copolymerizing the monomer represented by formula (M) as the binder of the invention. Suitable as the polymer, which can be used in combination, are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent or emulsion to form a coating solution.

The binder of the present invention preferably has a grass transition temperature (Tg) in a range of from −30° C. to 70° C., more preferably, in a range of from −10° C. to 50° C., and even more preferably in a range of from 0° C. to 40° C., considering manufacturing-related brittleness and image storability. Two or more polymers can be blended for the binder, and in this case, the blended polymer has a weighed averaged Tg which preferably falls within the range above, considering composition components. When the polymers exhibit phase separation or has a core-shell structure, a weighed averaged Tg preferably falls within the range above.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder of the invention can be readily obtained by a solution polymerizing method, a suspension polymerizing method, an emulsion polymerizing method, a dispersion polymerizing method, an anionic polymerizing method, a cationic polymerizing method, or the like, however most preferable is an emulsion polymerizing method by which polymer can be obtained as a latex. For example, the polymer latex is obtained by emulsion polymerization at about 30° C. to 100° C., preferably at 60° C. to 90° C., for 3 hours to 24 hours with stirring using water or a mixed solvent of water and a water-miscible organic solvent (for example, methanol, ethanol, acetone, or the like) as a dispersion medium, and using a monomer mixture in an amount of 5% by weight to 150% by weight with respect to the dispersion solvent, an emulsifying agent in an amount of 0.1% by weight to 20% by weight with respect to a total amount of monomers, and a polymerization initiator. Conditions such as the dispersion medium, monomer concentration, the amount of the initiator, the amount of the emulsifying agent, the amount of the dispersing agent, the reaction temperature, and the adding method of the monomer may be appropriately determined considering the kind of the monomer used. The dispersing agent is preferably used, if necessary.

Emulsion polymerization is usually carried out according to the following documents: "Gosei Jushi Emulsion (Synthetic Resin Emulsion)" ed. by Taira Okuda and Hiroshi Inagaki, Polymer Publishing Association (1978); "Gosei Latex no Oyo (Application of Synthetic Latex)" ed. by Takaaki Sugimura, Yasuo Kataoka, Soichi Suzuki and Keiji Kasahara, Polymer Publishing Association (1993); and "Gosei Latex no Kagaku (Chemistry of Synthetic Latex)" by Soichi Muroi, Polymer Publishing Association (1970).

Emulsion polymerizing method for synthesizing the polymer latex of the invention may be selected from an overall polymerizing method, a monomer addition (continuous or divided) method, an emulsion adding method and a seed polymerizing method. The overall polymerizing method, monomer adding (continuous or divided) method, and emulsion adding method are preferable in view of productivity of the latex.

The polymerization initiator described above has radical generation ability, and examples of them available include inorganic peroxides such as persulfate salts and hydrogen peroxide, peroxides described in the catalogue of organic peroxides by Nippon Oil and Fat Co., and azo compounds described in azo polymerization initiator catalogue by Wako Pure Chemical Industries, Ltd. Among them, water-soluble peroxides such as persulfate, and water-soluble azo compounds described in azo polymerization initiator catalogue by Wako Pure Chemical Industries, Ltd., are preferable. Ammonium persulfate, sodium persulfate, potassium persulfate, azobis(2-methylpropionamidine)hydrochloride, azobis(2-methyl-N-(2-hydroxyethyl)propionamide and azobiscyanovaleric acid are more preferable, and particularly, peroxides such as ammonium persulfate, sodium persulfate and potassium persulfate are preferable from the viewpoint of image storability, solubility, and cost.

The addition amount of the polymerization initiator described above is preferably in a range of from 0.3% by weight to 2.0% by weight, more preferably from 0.4% by weight to 1.75% by weight, and particularly preferably from 0.5% by weight to 1.5% by weight, based on a total amount of monomers. Image storability decreases when the amount of the polymerization initiator is less than 0.3% by weight, while the latex tends to be aggregated to deteriorate coating ability when the amount of the polymerization initiator exceeds 2.0% by weight.

As the polymerization emulsifying agent mentioned above, any surfactants such as an anionic surfactant, a nonionic surfactant, a cationic surfactant, or an amphoteric surfactant can be employed. An anionic surfactant is preferably employed from the viewpoint of dispersibility and image storability, and more preferred is a sulfonic acid-type anionic surfactant which maintains the polymerization stability even in a small amount and has a hydrolysis resistance. Preferred is a long chain alkyl diphenylether disulfonate such as "PELEX SS-H" (trade name, available from Kao Co., Ltd.), and particularly preferred is a low electrolyte-type surfactant such as "PIONIN A-43-S" (trade name, available from Takemoto Oil & Fat Co., Ltd.).

As the polymerization emulsifying agent mentioned above, a sulfonic acid-type surfactant is preferably used in a range of from 0.1% by weight to 10.0% by weight, based on a total amount of monomers, more preferably from 0.2% by weight to 7.5% by weight, and particularly preferably from 0.3% by weight to 5.0% by weight. Stability in the emulsion polymerization process can not secure when the addition amount of the polymerization emulsifying agent is less than 0.1% by weight, while image storability decreases when the addition amount exceeds 10.0% by weight.

Chelating agents are preferably used for the synthesis of the polymer latex used in the invention. The chelating agent is a compound capable of coordinating multi-valent metal ions such as iron ion, and alkali earth metal ions such as calcium ion, and examples thereof include the compounds described in Japanese Patent Application Publication (JP-B) No. 6-8956; U.S. Pat. No. 5,053,322; and JP-A Nos. 4-73645, 4-127145, 4-247073, 4-305572, 6-11805, 5-173312, 5-66527, 5-158195, 6-118580, 6-110168, 6-161054, 6-175299, 6-214352, 7-114161, 7-114154, 7-120894, 7-199433, 7-306504, 9-43792, 8-314090, 10-182571, 10-182570, and 11-190892.

The chelating agent used in the invention is preferably an inorganic chelating compound (sodium tripolyphosphate, sodium hexametaphosphate, sodium tetrapolyphosphate, or the like), an aminopolycarboxylic acid chelating compound (nitrilotriacetic acid, ethylenediamine tetraacetic acid, or the like), an organic phosphonic acid chelating agent (compounds described in Research Disclosure No. 18170, JP-A Nos. 52-102726; 53-42730, 56-97347, 54-121127, 55-4024, 55-4025, 55-29883, 55-126241, 55-65955, 55-65956, 57-179843, and 54-61125; and West Germany Patent (WGP) No. 1045373), a polyphenol chelating agent, or a polyamine chelating agent. An aminopolycarboxylic acid derivative is particularly preferable.

Preferable examples of the aminopolycarboxylic acid derivative are described in the supplement table of "EDTA (-Chemistry of Complexane-)", Nankodo 1977. A part of the carboxyl group of these compounds may be substituted by a salt of alkali metal such as sodium or potassium, or an ammonium salt. Particularly preferable aminocarboxylic acid derivatives include iminodiacetic acid, N-methyliminodiacetic acid, N-(2-aminoethyl)iminodiacetic acid, N-(carbamoylethyl)iminodiacetic acid, nitrilotriacetic acid, ehylenediamine-N,N'-diacetic acid, ehylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cic-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N', N'-tetraacetic acid, trans-1,4-diaminobutene-N,N',N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2-oxy-bis(ethyliminodiacetic acid), 2,2'-ethylenedioxy-bis(ethyliminodiacetic acid), ethylenediamine-N,N'-diacetic acid-N,N'-di-β-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N",N'",N'"-hexaacetic acid. A part of the carboxylic group of these compounds may be substituted by a salt of alkali metal such as sodium or potassium, or an ammonium salt.

The addition amount of the chelating agent described above is preferable from 0.01% by weight to 0.4% by weight, more preferably from 0.02% by weight to 0.3% by weight, and particularly preferably from 0.03% by weight to 0.15% by weight, based on a total amount of monomers. When the amount of the chelating agent is less than 0.01% by weight, metal ions contaminated in the production process of the polymer latex are insufficiently trapped to decrease stability of the latex against aggregation to deteriorate coating ability. When the amount exceeds 0.4% by weight, the viscosity of the latex increases to deteriorate coating ability.

The chain transfer agent is preferably used in the synthesis of the polymer latex used in the invention. A gelling ratio can be controlled by the addition of the chain transfer agent. The compounds described in Polymer Handbook Third Edition (Wiley-Interscience, 1989) are preferable as the chain transfer agents. Sulfur compounds are preferable since they have high chain transfer ability to make the amount of use of the reagent small. Particularly preferable chain reaction agents are hydrophobic mercaptan chain transfer agents such as tert-dodecylmercaptan, n-dodecylmercaptan, and the like.

The amount of the chain transfer agent described above is preferably from 0.2% by weight to 2.0% by weight, more preferably from 0.3% by weight to 1.8% by weight, and particularly preferably from 0.4% by weight to 1.6% by weight, based on a total amount of monomers. Manufacturing-related brittleness is decreased when the amount of the chain transfer agent is less than 0.2% by weight, while image storability is deteriorated when the amount exceeds 2.0% by weight.

In the emulsion polymerization, additives such as an electrolyte, a stabilizer, a viscosity increasing agent, an antifoaming agent, an antioxidant, a vulcanizing agent, an antifreeze agent, a gelling agent, vulcanization accelerator, or the like described in Synthetic Rubber Handbook and the like may be used in addition to the compounds above.

SPECIFIC EXAMPLES OF POLYMER

Specific examples of the polymer used in the present invention are listed below (compound Nos. P-1 to P-29), however the invention is not restricted to these. x, y, z, and z' in chemical formula show the mass ratios in the polymer composition, and the sum of x, y, z, and z' is equal to 100%. Tg represents the glass transition temperature of a dry film obtained from the polymer.

P-1
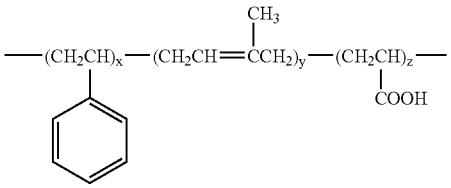
Tg = 17° C.
x = 61.5
y = 35.5
z = 3
P-2
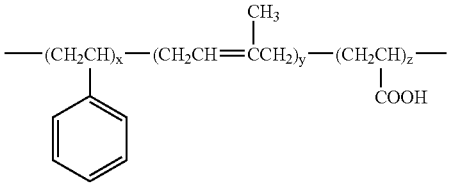
Tg = 20° C.
x = 63
y = 34
z = 3
P-3
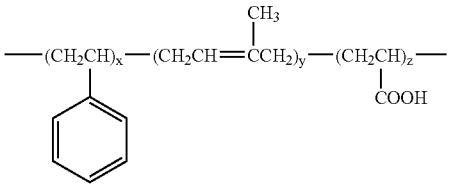
Tg = 24° C.
x = 65
y = 32
z = 3
P-4
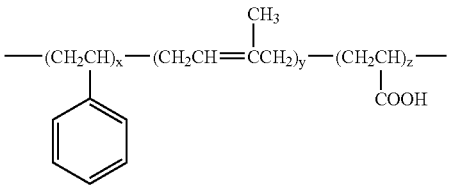
Tg = 13° C.
x = 59.5
y = 37.5
z = 3
P-5
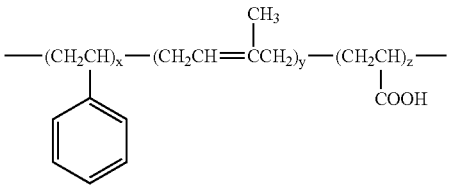
Tg = -7° C.
x = 45
y = 50
z = 5
-continued
P-6
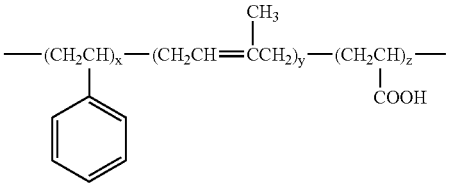
Tg = 60° C.
x = 79
y = 15
z = 6
P-7
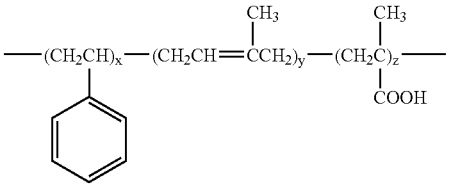
Tg = 8° C.
x = 55
y = 41
z = 4
P-8
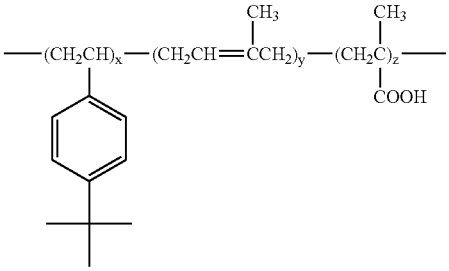
Tg = 32° C.
x = 60
y = 35
z = 5
P-9
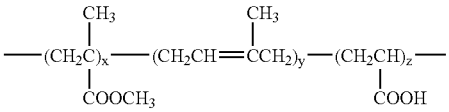
Tg = 24° C.
x = 62
y = 33
z = 5
P-10
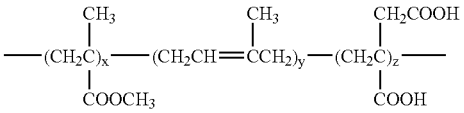
Tg = 28° C.
x = 63
y = 33
z = 4

-continued
P-11
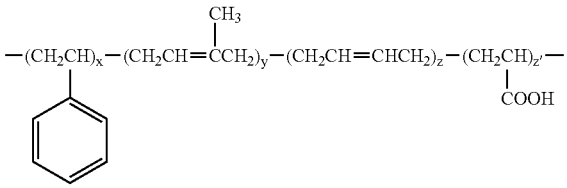
Tg = 8° C.
x = 57
y = 35
z = 5
z′ = 3
P-12
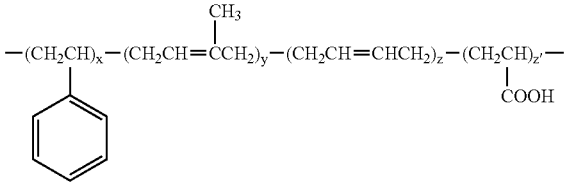
Tg = 27° C.
x = 67
y = 28
z = 2
z′ = 3
P-13
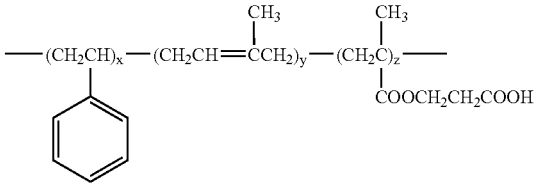
Tg = 32° C.
x = 70
y = 20
z = 15
P-14
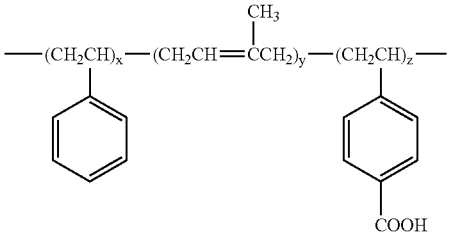
Tg = 50° C.
x = 65
y = 20
z = 15
-continued
P-15
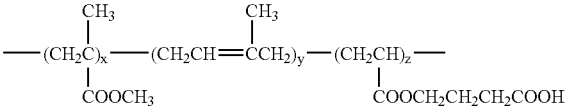
Tg = 3° C.
x = 50
y = 38
z = 12
P-16
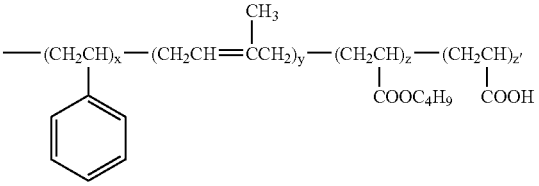
Tg = 24° C.
x = 60
y = 10
z = 25
z′ = 5
P-17
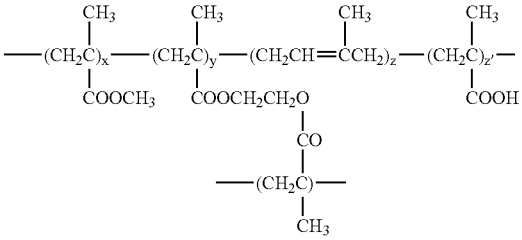
Tg = 66° C.
x = 79
y = 2
z = 15
z′ = 4
P-18
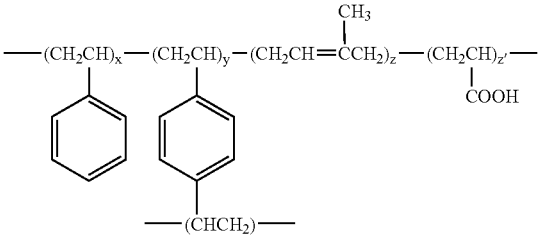
Tg = 35° C.
x = 66
y = 2
z = 29
z′ = 3

-continued
P-19
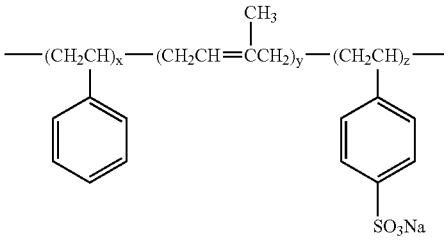
Tg = 18° C.
x = 63
y = 35
z = 2
P-20
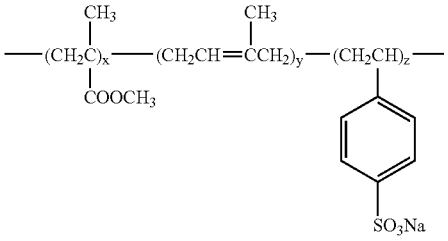
Tg = 3° C.
x = 51
y = 45
z = 4
P-21
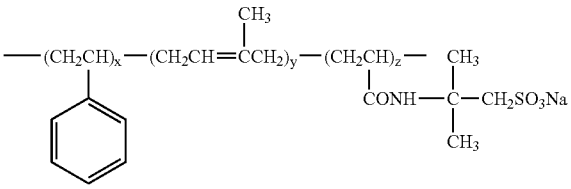
Tg = -30° C.
x = 29
y = 70
z = 1
P-22
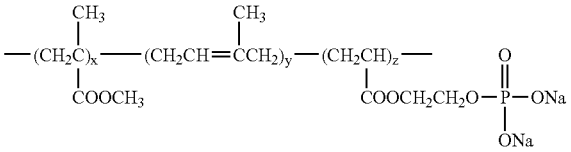
Tg = -12° C.
x = 43
y = 54
z = 3
P-23
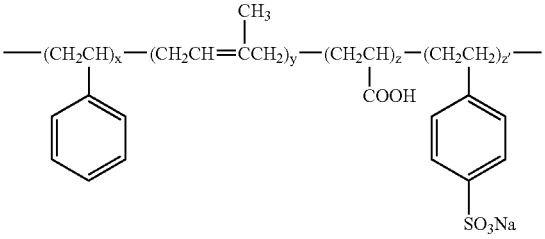
Tg = 28° C.
x = 67
y = 30
z = 1
z′ = 2
-continued
P-24
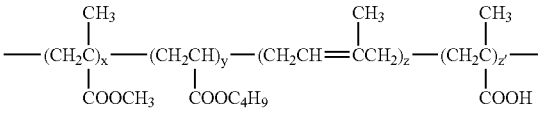
Tg = 42° C.
x = 70
y = 22
z = 5
z′ = 3
P-25
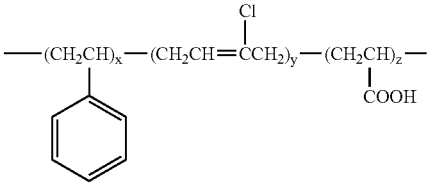
Tg = 21° C.
x = 55
y = 42
z = 3
P-26
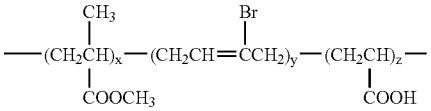
Tg = -10° C.
x = 49
y = 58
z = 3
P-27
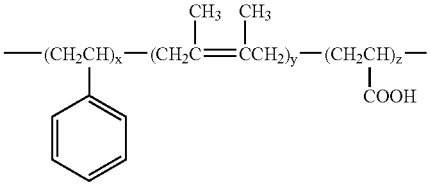
Tg = 28° C.
x = 40
y = 57
z = 3
P-28
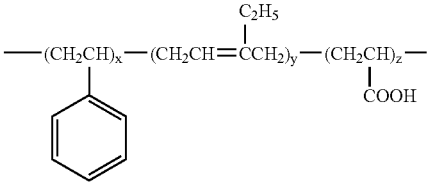
Tg = 26° C.
x = 68
y = 28
z = 4
P-29
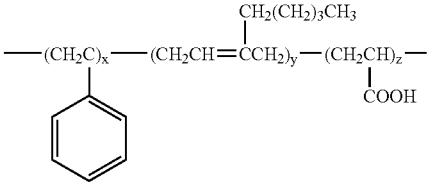
Tg = 53° C.
x = 80
y = 15
z = 5

While examples of synthesis of the polymers used in the invention are shown below, the invention is not restricted to the synthetic methods shown below. Similar synthetic method may be used for other compounds in the examples.

Synthetic Example 1

Synthesis of Illustrated Compound No. P-1

Into the polymerization vessel of gas monomer reaction apparatus (type TAS-2J, manufactured by Taiatsu Techno Corp.), 1500 g of distilled water were poured and heated for 3 hours at 90° C. to make passive film over the stainless-steel vessel surface and stainless-steel stirring device. Into the polymerization vessel after this treatment were added 584.86 g of distilled water which was bubbled with nitrogen gas for 1 hour, 9.45 g of a surfactant (PIONIN A-43-S produced by Takemoto Oil and Fats Cp.), 20.25 g of 1 mol/L sodium hydroxide, 0.216 g of ethylenediamine tetraacetic acid tetrasodium salt, 332.1 g of styrene, 191.7 g of isoprene, 16.2 g of acrylic acid, and 4.32 g of tert-dodecyl mercaptan. And then the reaction vessel was sealed the mixture was stirred at 225 rpm, followed by elevating the inner temperature to 60° C. To the aforementioned mixture was added a solution prepared through dissolving 2.7 g of ammonium persulfate in 50 mL of water, and kept for 7 hours with stirring. Furthermore, the mixture was heated to 90° C. with stirring for 3 hours. After the reaction was completed, the inner temperature of the reaction vessel was cooled to room temperature. The polymer obtained was filtered through a filter cloth (mesh: 225), then 1145 g of the example compound No. P-1 (solid content of 45% by weight, mean particle diameter of 112 nm) was obtained.

Synthetic Example 2

Synthesis of Compound No. P-2

Into the reaction vessel of gas monomer reaction apparatus (type TAS-2J manufactured by Tiatsu Garasu Kogyo Ltd.) pretreated to make passive film similar to the above-described Synthetic Example 1, 350.92 g of distilled water which was bubbled with nitrogen gas for 1 hour, 3.78 g of the surfactant (PIONIN A-43-S produced by Takemoto Oil and Fats Cp.), 20.25 g of 1 mol/L sodium hydroxide, 0.216 g of ethylenediamine tetraacetic acid tetrasodium salt, 34.02 g of styrene, 18.36 g of isoprene, 1.62 g of acrylic acid, and 2.16 g of tert-dodecyl mercaptan were added. Thereafter, the reaction vessel was sealed and the mixture was stirred at 225 rpm, followed by elevating the inner temperature to 65° C. To this mixture was added a solution prepared through dissolving 1.35 g of ammonium persulfate in 50 mL of water and kept for 2 hours with stirring. An emulsion was separately prepared by adding, with stirring, 233.94 g of distilled water, 5.67 g of the surfactant (PIONIN A-43-S produced by Takemoto Oil and Fats Cp.), 306.18 g of styrene, 165.24 g of isoprene, 14.58 g of acrylic acid, 2.16 g of tert-dodecyl mercaptan, and 1.35 g of ammonium persulfate. The emulsion was poured dropwise over 8 hours into the reaction vessel described above. The reaction solution was further stirred for 2 hours after completing the addition. Thereafter the resulting mixture was further stirred for 3 hours by elevating the temperature at 90° C. After the reaction was completed, the inner temperature of the reaction vessel was cooled to room temperature. The polymers obtained was filtered through a filter cloth (mesh: 225), then 1147 g of the example compound No. P-2 (solid content of 45% by weight, mean particle diameter of 121 nm) was obtained.

Synthetic Example 3

Synthesis of Compound No. P-4

Into the reaction vessel of gas monomer reaction apparatus (type TAS-2J manufactured by Tiatsu Garasu Kogyo Ltd.) pretreated to make passive film similar to the above-described Synthetic example 1, 578.11 g of distilled water which was bubbled with nitrogen gas for one hour, 16.2 g of the surfactant (PELEX SS-H produced by Kao Co., Ltd.), 20.25 g of 1 mol/L sodium hydroxide, 0.216 g of ethylenediamine tetraacetic acid tetrasodium salt, 321.3 g of styrene, 202.5 g of isoprene, 1.62 g of acrylic acid, and 4.32 g of tert-dodecyl mercaptan were added. Thereafter the reaction vessel was sealed and the mixture was stirred at the stirring rate of 225 rpm, followed by elevating the inner temperature to 60° C. To the mixture was added a solution prepared through dissolving 2.7 g of ammonium persulfate in 25 mL of water, and kept for 5 hours with stirring. Furthermore a solution obtained dissolving 1.35 g of ammonium persulfate dissolved in 25 mL of water was added to the mixture. Then the mixture was heated to 90° C. and stirred for 3 hours. After the reaction was completed, the inner temperature of the vessel was cooled to room temperature. The polymers obtained was filtered through filter cloth (mesh: 225), then 1139 g of the example compound No. P-4 (solid content of 45% by weight, mean particle diameter of 105 nm) was obtained.

In the present invention, for the solvent of a coating solution for the polymer latex, aqueous solvent can be used and any of water-miscible organic solvents may be used in combination.

As water-miscible organic solvents, there can be used, for example, alcohols such as methyl alcohol, ethyl alcohol, propyl alcohol, or the like; cellosolves such as methyl cellosolve, ethyl cellosolve, butyl cellosolve, and the like; ethyl acetate, dimethylformamide, or the like.

The addition amount of the organic solvent is preferably 50% by weight or less, and more preferably 30% by weight or less, with respect to the solvent.

Concerning the polymer latex of the present invention, the concentration of the polymer is preferably from 10% by weight to 70% by weight, more preferably from 20% by weight to 60% by weight, and particularly preferably from 30% by weight to 55% by weight, with respect to the latex liquid in each case.

Concerning the binder polymer of the present invention, the equilibrium water content under 25° C. and 60% RH is preferably 2% by weight or lower, more preferably, in a range of from 0.01% by weight to 1.5% by weight, and even more preferably, from 0.02% by weight to 1.0% by weight.

The term "equilibrium water content under 25° C. and 60% RH" as referred herein can be expressed as follows:

$$\text{Equilibrium water content under 25° C. and 60\% RH} = [(W1 - W0)/W0] \times 100 \text{ (\% by weight)}$$

wherein W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

In the present invention, polymers capable of being dispersed in an aqueous solvent are particularly preferable. Examples of dispersed states may include a latex, in which water-insoluble fine particles of hydrophobic polymer are dispersed, or such in which polymer molecules are dispersed in molecular states or by forming micelles, but preferred are latex-dispersed particles. A mean particle diameter of the latex-dispersed particles is in a range from 1 nm to 50000 nm, preferably from 5 nm to 1000 nm, more preferably from 10 nm to 500 nm, and even more preferably from 50 nm to 200 nm. There is no particular limitation concerning particle diameter distribution of the dispersed particles, and they may be widely distributed or may exhibit a monodisperse particle diameter distribution. From the viewpoint of controlling physical properties of the coating solution, preferred mode of usage includes mixing two or more types of particles each having monodisperse particle diameter distribution.

In the image forming layer of the present invention, if necessary, there can be added hydrophilic polymers such as gelatin, poly(vinyl alcohol), methyl cellulose, hydroxypropyl cellulose, carboxymethyl cellulose, or the like. The hydrophilic polymers above are added in an amount of 30% by weight or less, preferably 20% by weight or less, with respect to the total weight of the binder incorporated in the image forming layer.

The image forming layer of the present invention is preferably formed by using the polymer latex of the present invention. Concerning the amount of the binder for the image forming layer, the mass ratio of total binder relative to organic silver salt (total binder/organic silver salt) is preferably in a range of from 1/10 to 10/1, more preferably from 1/3 to 5/1, and even more preferably from 1/1 to 3/1.

A mass ratio of total binder relative to photosensitive silver halide (total binder/photosensitive silver halide) is preferably in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. Concerning the image forming layer of the invention, there may be added a crosslinking agent for crosslinking, a surfactant to improve coating ability, or the like.

(Compound Represented by Formula (SA))

The compound represented by formula (SA), which is used in the present invention, is explained in detail.

Formula (SA)

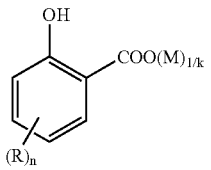

In formula (SA), M represents a hydrogen atom or an anion having a valency of k (for example, a metal ion such as sodium ion, potassium ion, calcium ion, barium ion, or zinc ion; an ammonium ion such as tetramethyl ammonium ion or tetrabutyl ammonium ion; or the like). k is an integer of one or more, like as the illustrated ion shows, and it is usually one or two. When M is a hydrogen atom, k is one. M is preferably a heavy metal ion and specifically zinc, iron, manganese, cadmium, chromium, cobalt, rhutenium, rhodium, silver, or the like.

In formula (SA), R represents a substituent, for example, linear, branched, or heterocyclic alkyl group (preferably, having 1 to 20 carbon atoms, more preferably, having 1 to 12 carbon atoms, and particularly preferably, having 1 to 8 carbon atoms; for example, methyl, ethyl, iso-propyl, t-butyl, n-octyl, 1,1,3,3-tetramethylbutyl, t-amyl, cyclohexyl, and the like are described), an alkenyl group (preferably, having 2 to 20 carbon atoms, more preferably, having 2 to 12 carbon atoms, and particularly preferably, having 2 to 8 carbon atoms; for example, vinyl, allyl, 2-butenyl, 3-pentenyl, and the like are described), an alkynyl group (preferably, having 2 to 20 carbon atoms, more preferably, having 2 to 12 carbon atoms, and particularly preferably, having 2 to 8 carbon atoms; for example, propargyl, 3-pentynyl, and the like are described), an aralkyl group (preferably, having 7 to 30 carbon atoms, more preferably, having 7 to 20 carbon atoms, and particularly preferably, having 7 to 16 carbon atoms; for example, benzyl, α-methylbenzyl, α-ethylbenzyl, diphenylmethyl, naphthylmethyl, naphthylphenylmethyl, and the like are described), an aryl group (preferably, having 6 to 30 carbon atoms, more preferably, having 6 to 20 carbon atoms, particularly preferably, having 6 to 12 carbon atoms; for example, phenyl, p-methylphenyl, naphthyl, and the like are described), an amino group (preferably, having 0 to 20 carbon atoms, more preferably, having 0 to 10 carbon atoms, even more preferably, having 0 to 6 carbon atoms; for example, amino, methylamino, dimethylamino, diethylamino, dibenzylamino, and the like are described), an alkoxy group (preferably, having 1 to 20 carbon atoms, more preferably, having 1 to 12 carbon atoms, particularly preferably, having 1 to 8 carbon atoms; for example, methoxy, ethoxy, butoxy, and the like are described), an aryloxy group (preferably, having 6 to 20 carbon atoms, more preferably, having 6 to 16 carbon atoms, and particularly preferably, having 6 to 12 carbon atoms; for example, phenyloxy, 2-naphthyloxy, and the like are described), an acyl group (preferably, having 1 to 20 carbon atoms, more preferably, having 1 to 16 carbon atoms, and particularly preferably, having 1 to 12 carbon atoms; for example, acetyl, benzoyl, formyl, pivaloyl, and the like are described), an alkoxycarbonyl group (preferably, having 2 to 20 carbon atoms, more preferably, having 2 to 16 carbon atoms, and particularly preferably, having 2 to 12 carbon atoms; for example, methoxycarbonyl, ethoxycarbonyl, and the like are described), an aryloxycarbonyl group (preferably, having 7 to 20 carbon atoms, more preferably, having 7 to 16 carbon atoms, and particularly preferably, having 7 to 10 carbon atoms; for example, phenoxycarbonyl and the like are described), an acyloxy group (preferably, having 1 to 20 carbon atoms, more preferably, having 2 to 16 carbon atoms, and particularly preferably, having 2 to 10 carbon atoms; for example, acetoxy, benzoyloxy, and the like are described), an acylamino group (preferably, having 1 to 20 carbon atoms, more preferably, having 2 to 16 carbon atoms, and particularly preferably, having 2 to 10 carbon atoms; for example, acetylamino, benzoylamino, and the like are described), an alkoxycarbonylamino group (preferably, having 2 to 20 carbon atoms, more preferably, having 2 to 16 carbon atoms, and particularly preferably, having 2 to 12 carbon atoms; for example, methoxycarbonylamino and the like are described), an aryloxycarbonylamino group (preferably, having 7 to 20 carbon atoms, more preferably, having 7 to 16 carbon atoms, and particularly preferably, having 7 to 12 carbon atoms; for example, phenyloxycarbonylamino and the like are described), a sulfonylamino group (preferably, having 1 to 20 carbon atoms, more preferably, having 1 to 16 carbon atoms, and particularly preferably, having 1 to 12 carbon atoms; for example, methanesulfonylamino, benzenesulfonylamino, and the like are described), a sulfamoyl group (preferably, having 0 to 20 carbon atoms, more preferably, having 0 to 16 carbon atoms, and particularly preferably, having 0 to 12 carbon atoms; for example, sulfamoyl, methylsulfamoyl, dimethylsulfamoyl, phenylsulfamoyl, and the like are described), a carbamoyl group (preferably, having 0 to 20 carbon atoms, more preferably, having 0 to 16 carbon atoms, and particularly preferably, having 0 to 12 carbon atoms; for example, carbamoyl, diethylcarbamoyl, phenylcarbamoyl, and the like are described), a ureido group (preferably, having 1 to 20 carbon atoms, more preferably, having 1 to 16 carbon atoms, and particularly preferably, having 1 to 12 carbon atoms; for example, ureido, methylureido, phenylureido, and the like are described), an alkylthio group (preferably, having 1 to 20 carbon atoms, more preferably, having 1 to 16 carbon atoms, and particularly preferably, having 1 to 12 carbon atoms; for example, methylthio, ethylthio, and the like are described), an arylthio group (preferably, having 6 to 20 carbon atoms, more preferably, having 6 to 16 carbon atoms, and particularly preferably, having 6 to 12 carbon atoms; for example, phenylthio and the like are described), a sulfony group (preferably, having 1 to 20 carbon atoms, more preferably, having 1 to 16 carbon atoms, and particularly preferably, having 1 to 12 carbon atoms; for example, mesyl, tosyl, and the like are described), a sulfinyl group (preferably, having 1 to 20 carbon atoms, more preferably, having 1 to 16 carbon atoms, and particularly preferably, having 1 to 12 carbon atoms; for example, methanesulfinyl, benzenesulfinyl, and the like are described), amide phosphate group (preferably, having 1 to 20 carbon atoms, more preferably, having 1 to 16 carbon atoms, and particularly preferably, having 1 to 12 carbon atoms; for example, diethyl amide phosphate, phenyl amide phosphate, and the like are described), a hydroxy group, a mercapto group, a halogen atom (for example, a fluorine atom, a chlorine atom, a bromine atom, or an iodine atom), a cyano group, a sulfo group, a carboxy group, a nitro group, a hydroxamic group, a sulfino group, a hydrazino group, a sulfonylthio group, a thiosulfonyl group, a heterocyclic group (for example, imidazolyl, pyridyl, furyl, piperidyl, morpholyl, and the like are described), a disulfide group, and the like are described.

These substituents may be further substituted and may form salts when these groups are possible to form salts. n represents a integer from 1 to 4, however when there are two or more substituents, namely n is 2 or more, these may be the same or different. n is preferably 1, 2, or 3, and most preferably, 2.

Further, these substituents may bond to each other to form a 5- to 7-membered aromatic or non-aromatic carbon ring (for example, a benzene ring). Furthermore, this ring may be substituted by another substituent (for example, a halogen atom or a carboxy group).

The substituent represented by R is preferably an alkyl group, an alkenyl group, an alkynyl group, an aralkyl group, an aryl group, an amino group, an alkoxy group, an acyl group, an alkoxycarbonyl group, an acyloxy group, an acylamino group, an alkoxycarbonylamino group, a sulfonylamino group, a sulfamoyl group, a carbamoyl group, a ureido group, an alkylthio group, a sulfonyl group, a hydroxy group, a mercapto group, a halogen atom, a cyano group, a sulfo group, a carboxy group, a nitro group, a heterocyclic group, and more preferably an alkyl group, an alkenyl group, an aralkyl group, an amino group, an alkoxy group, an alkylthio group, a hydroxy group, a mercapto group, a halogen atom, a sulfo group, or a carboxy group.

Furthermore, in formula (SA), it is particularly preferable that an alkyl group (including an aralkyl group) substitutes at an ortho-position and/or a para-position of the hydroxy group.

Further preferably, the compound of formula (SA) has a bisphenol structure which is bonded through one carbon atom.

Next, specific examples of the compound represented by formula (SA) of the present invention are shown below, however the present invention is not limited in these.

SA-1

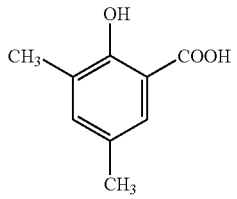

SA-2

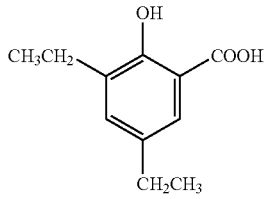

SA-3

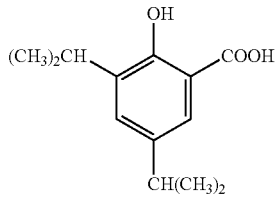

-continued
SA-4
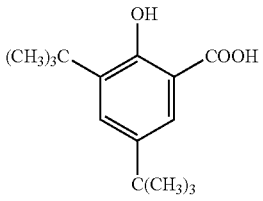
SA-5
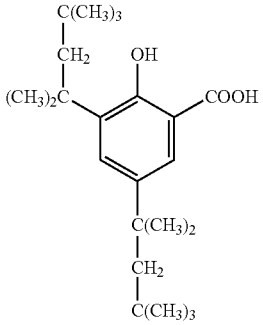
SA-6
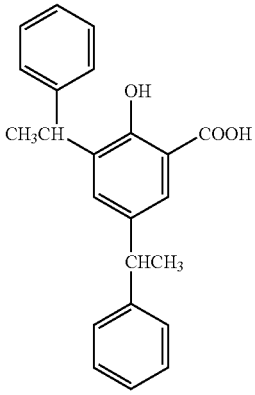
SA-7
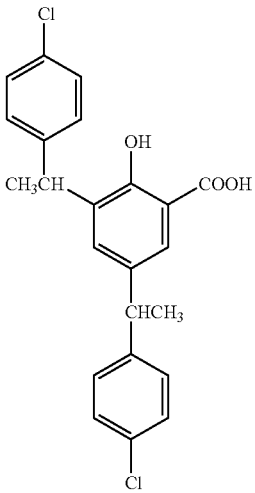
-continued
SA-8
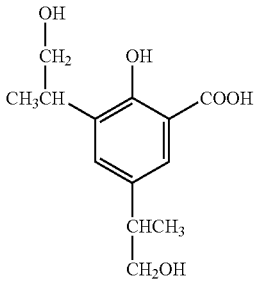
SA-9
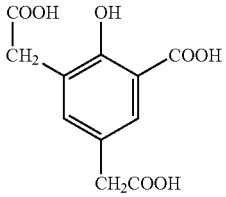
SA-10
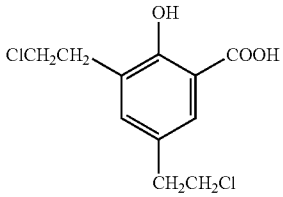
SA-11
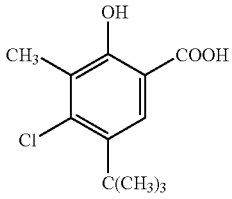
SA-12
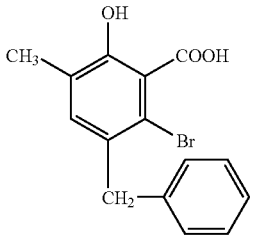
SA-13
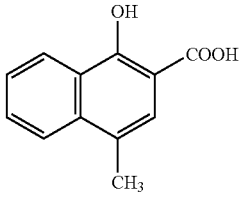

-continued
SA-14
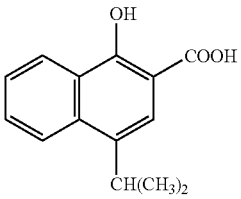
SA-15
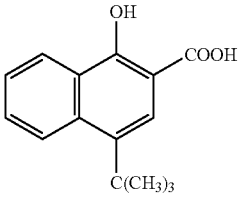
SA-16
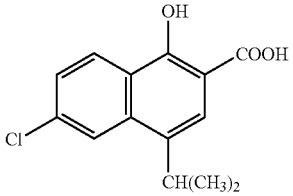
SA-17
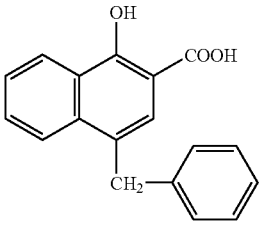
SA-18
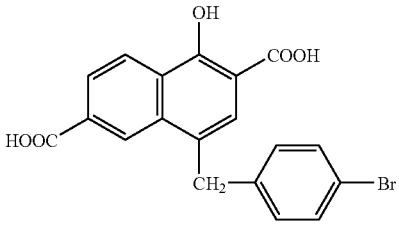
SA-19
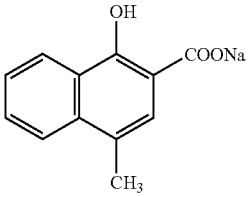
-continued
SA-20
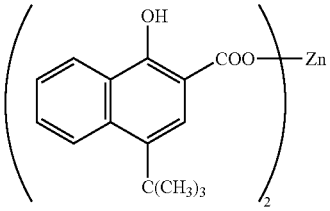
SA-21
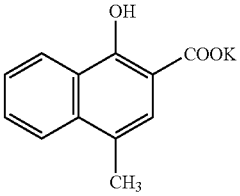
SA-22
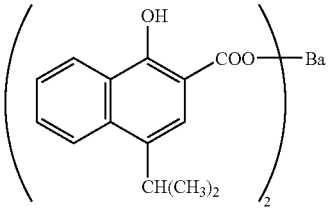
SA-23
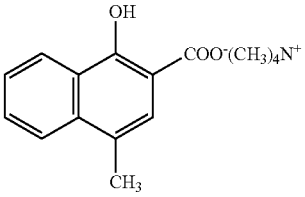
SA-24
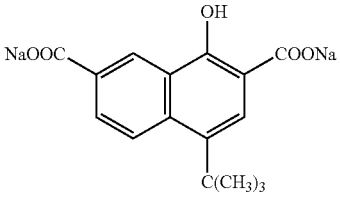
SA-25
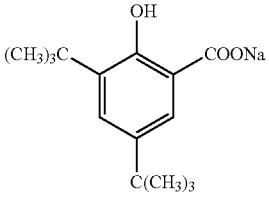

-continued
SA-26
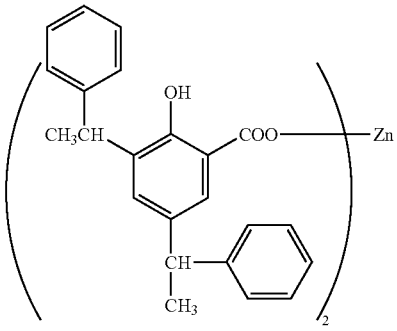
SA-27
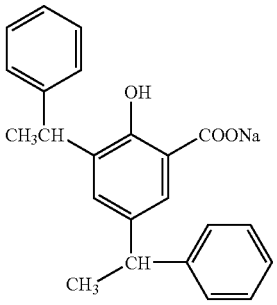
SA-28
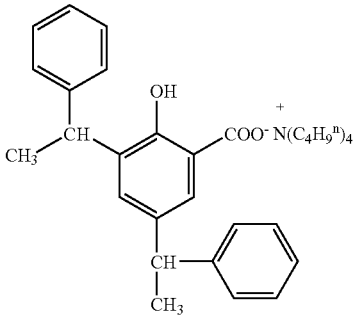
SA-29
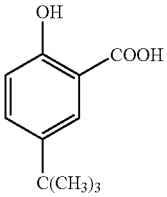
SA-30
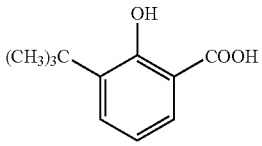
SA-31
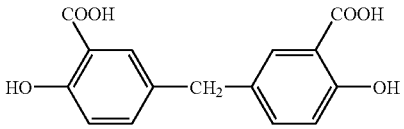
-continued
SA-32
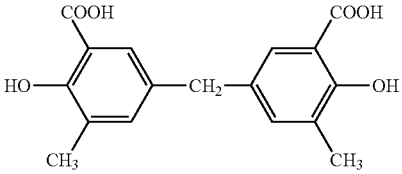
SA-33
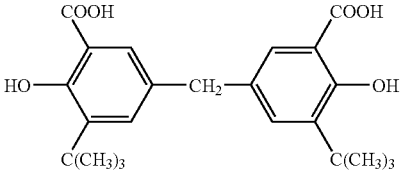
SA-34
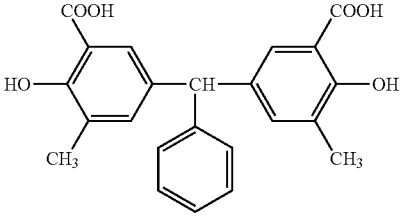
SA-35
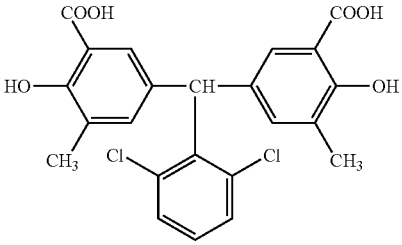
SA-36
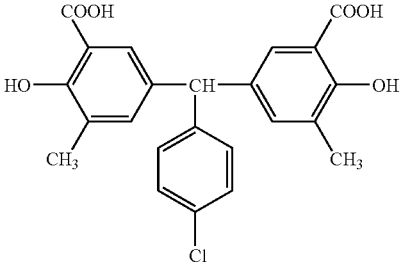
SA-37
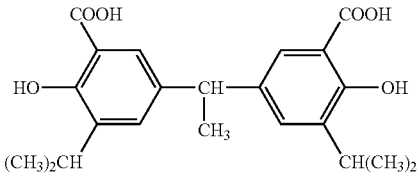

-continued
SA-38
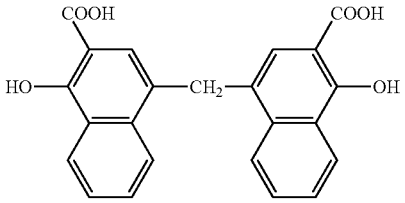
SA-39
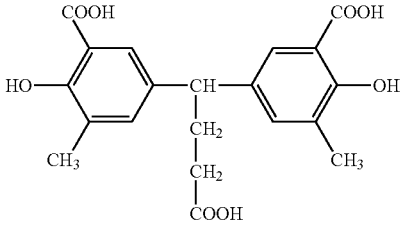
SA-40
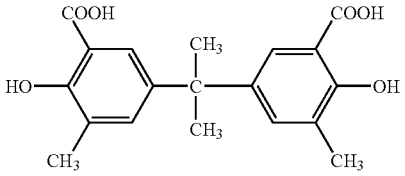
SA-41
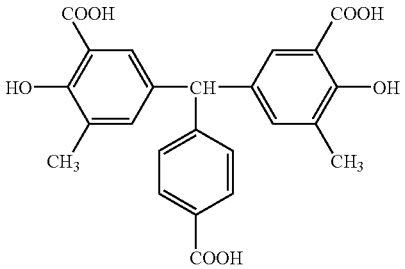
SA-42
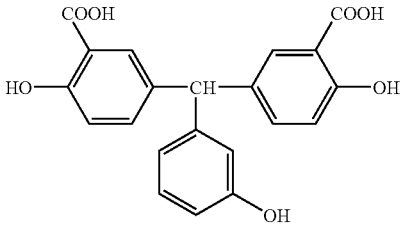
SA-43
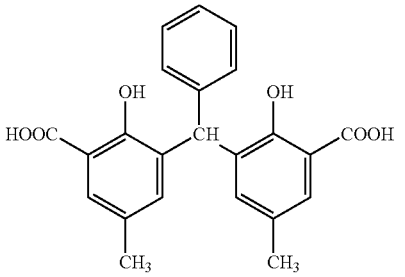
-continued
SA-44
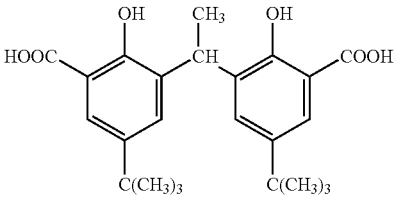
SA-45
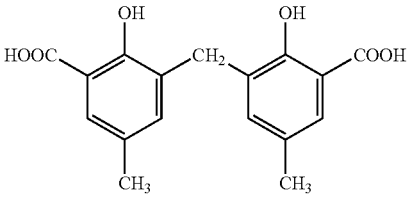
SA-46
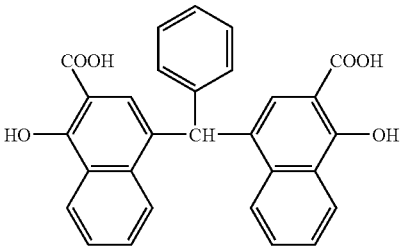
SA-47
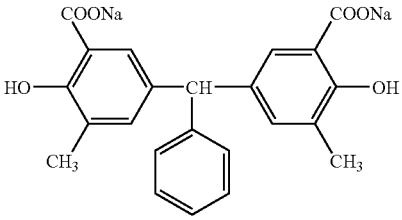
SA-48
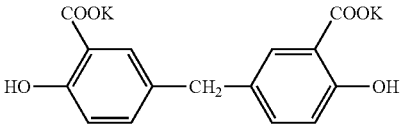
SA-49
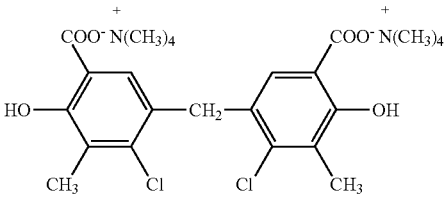

-continued
SA-50
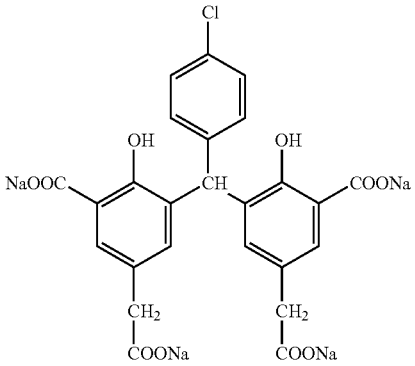
SA-51
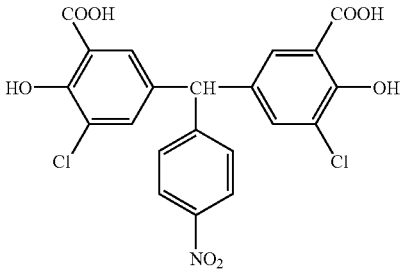
SA-52
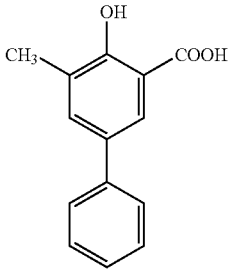
SA-53
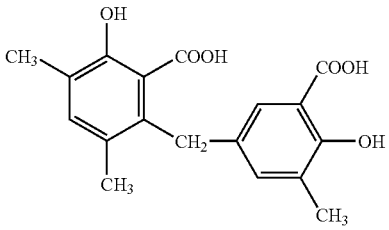
SA-54
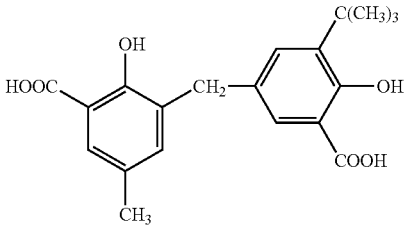
-continued
SA-55
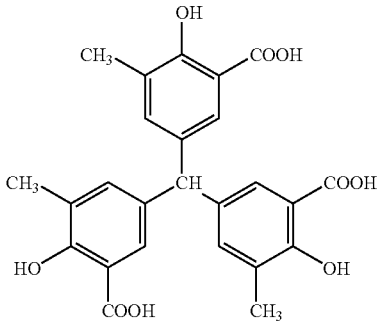
SA-56
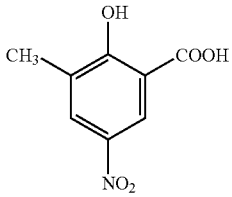
SA-57
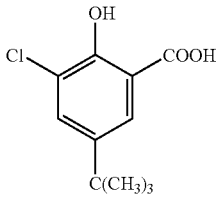
SA-58
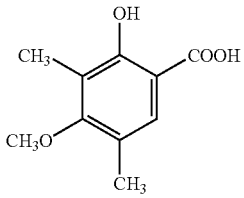
SA-59
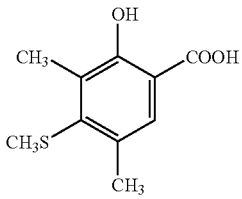
SA-60
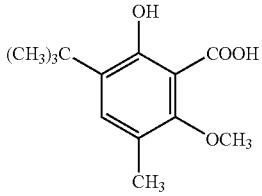

As the compound represented by formula (SA) of the present invention, commercially avaivable compound may be used. The compound represented by formula (SA) of the present invention can be easily synthesized, for example, by the method described in JP-A No. 251838, by an acid-catalyzed condensation reaction with salicylic acid and carbonyl compound described in J. Med. Chem., vol. 34, page 342 (1991) and the like.

The compound of formula (SA) in the present invention can be used by dissolving it in water or a suitable organic solvent, for example, alcohols (methanol, ethanol, propanol, or fluoroalcohol), ketones (acetone or methylethyl ketone), dimethylformamide, dimethylsufoxide, methylcellusolve, or the like.

Further, the compound can be used in the form of an emulsified dispersion or a solid fine particle dispersion. As well known emulsified dispersing method, there can be mentioned a method comprising dissolving the compound in an oil such as dibutylphthalate, tricresylphosphate, glyceryl triacetate, diethylphthalate, or the like, and an auxiliary solvent such as ethyl acetate, cyclohexanone, or the like; from which an emulsified dispersion is mechanically produced. As well-known solid dispersing method, there can be mentioned a method comprising dispersing the powder of the compound in water by means of a ball mill, a colloid mill, a sand grinder mill, a manton-gorlin mill, a micro fluidizer, or an ultrasonics, thereby obtaining solid dispersion.

The compound of formula (SA) of the present invention may be added to any layer which is disposed on the same side of the support as image forming layer, namely the image forming layer or any other layer of this layer side, but it is preferable to add the compound to the image forming layer or the layer adjacent to the image forming layer.

The addition amount of the compound represented by formula (SA), which is showed by molar quantity per 1 mol of coated silver (mol/mol Ag), is preferably from $1\times10^{-5}$ mol/mol Ag to $5\times10^{-1}$ mol/mol Ag, more preferably from $5\times10^{-5}$ mol/mol Ag to $1\times10^{-1}$ mol/mol Ag, and even more preferably from $1\times10^{-4}$ mol/mol Ag to 5×1 0-2 mol/mol Ag. The compound may be used alone or two or more of them may be used in combination.

(Non-Photosensitive Organic Silver Salt)

1) Composition

The organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cuboidal, or potato-like indefinite shaped particles with the major axis to minor axis ratio being lower than 5 are also used preferably. Such organic silver salt particles suffer less from fogging during thermal development compared with long needle-like particles with the major axis to minor axis length ratio of 5 or higher. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧=1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt according to the invention can be used in a desired amount, a total amount of coated silver including silver halide is preferably in a range of from 0.1 $g/m^2$ to 5.0 $g/m^2$, more preferably from 0.3 $g/m^2$ to 3.0 $g/m^2$, and even more preferably from 0.5 $g/m^2$ to 2.0 $g/m^2$. In particular, in order to improve image storability, the total amount of coated silver is preferably 1.8 $mg/m^2$ or less, and more preferably 1.6 $mg/m^2$ or less. When a preferable reducing agent in the invention is used, it is possible to obtain a sufficient image density by even such a low amount of silver.

(Metal Phthalocyanine Dye Represented by Formula (PC-1))

The metal phthalocyanine dye represented by formula (PC-1) according to the present invention is explained.

The metal phthalocyanine dye represented by formula (PC-1) used for the present invention preferably has a half band width of 100 nm or less at the maximum absorbance, more preferably, a half band width of 80 nm or less, and even more preferably, a half band width of 50 nm or less.

The wavelength region having the maximum absorbance is preferably in a range of from 600 nm to 750 nm, more preferably from 600 nm to 720 nm, and even more preferably from 620 nm to 700 nm.

Formula (PC-1)

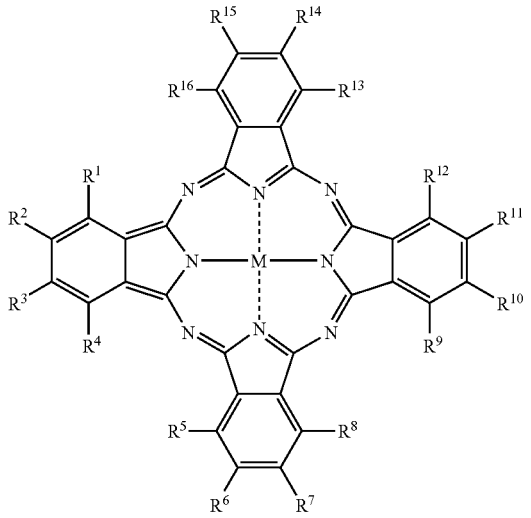

In formula (PC-1), M represents a metal atom. The metal atom may be any metal which forms a stable complex, and a metal selected from the group consisting of Li, Na, K, Be, Mg, Ca, Ba, Al, Si, Cd, Hg, Cr, Fe, Co, Ni, Cu, Zn, Ge, Pd, Sn, Pt, Pb, Sr, or Mn can be used. Mg, Ca, Co, Zn, Pd, or Cu is preferably used, more preferably, Co, Pd, Zn, or Cu is used, and particularly preferably, Cu is used.

<Substituents and the Like>

In formula (PC-1), $R^1$, $R^4$, $R^5$, $R^8$, $R^9$, $R^{12}$, $R^{13}$, and $R^{16}$ each independently represent a hydrogen atom, a substituent, or an electron-attracting group, and at least one of $R^1$, $R^4$, $R^5$, $R^8$, $R^9$, $R^{12}$, $R^{13}$, and $R^{16}$ is an electron-attracting group.

The electron-attracting group herein is selected from groups represented by a halogen atom, a cyano group, a nitro group, —C(═O)—R, —C(═O)—C(═O)—R, —S(═O)—R, —S(═O)$_2$—R, —C(═N—R')—R, —S(═NR')—R, —S(═NR')$_2$—R, —P(═O)R$_2$, —O—R", —S—R", —N(—R')—C(═O)—R, —N(—R')—S(═O)—R, —N(—R')—S(═O)$_2$—R, —N(—R')—C(═N—R')—R, —N(—R')—S(═NR')$_2$—R, and —N(—R')—P(═O)R$_2$. Herein R represents one selected from a hydrogen atom, an alkyl group, an aryl group, a heterocyclic group, an amino group, an alkyloxy group, an aryloxy group, a heterocyclic oxy group, a hydroxy group, an alkylthio group, an arylthio group, a heterocyclic thio group, or an SH group. R' represents one selected from a hydrogen atom, an alkyl group, an aryl group, a heterocyclic group, an acyl group, a sulfonyl group, a sulfinyl group, or a phosphoryl group. R" represents one selected from a perfluoro alkyl group, a cyano group, an acyl group, a sulfonyl group, or a sulfinyl group.

The groups represented by R, R', and R" may be substituted by a substituent. Specific examples of the substituent include a halogen atom (a fluorine atom, a chlorine atom, a bromine atom, or an iodine atom), an alkyl group (including an aralkyl group, a cycloalkyl group, an active methine group, and the like), an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, an acylamino group, a sulfonamide group, an ureido group, a thioureido group, an imide group, an alkoxycarbonylamino group, an aryloxycarbonylamino group, a sulfamoylamino group, a semicarbazide group, a thiosemicarbazide group, a hydrazino group, an ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, a group containing a phosphoric amide structure or a phosphate ester structure), a silyloxy group (for example, trimethylsilyloxy, or t-butyldimethylsilyloxy), a silyl group (for example, trimethylsilyl, t-butyldimethylsilyl, or phenyldimethylsilyl), and the like. These substituents may be further substituted by these substituents.

In formula (PC-1), a group represented by formula (II) is preferably used as an electron-attracting group.

$$-L^1-R^{17} \qquad \text{Formula (II)}$$

$L^1$ represents a group selected from **—$SO_2$—*, **$SO_3$*, **—$SO_2NR_N$—*, **—SO—*, **—CO—*, **—$CONR_N$—*, **—COO—*, **—COCO—*, **—$COCO_2$—*, and $COCONR_N$—*. ** denotes a bond with a phthalocyanine skeleton at this position. * denotes a bond with $R^{17}$ at this position. RN represents one selected from a hydrogen atom, an alkyl group, an aryl group, a heterocyclic group, an acyl group, an alkoxycarbonyl group, a carbamoyl group, a sulfonyl group, or a sulfamoyl group. RN may further be substituted by a substituent which $R_1$, $R_2$, $R_3$, $R_4$, $R_5$, $R_6$, $R_7$, and $R_8$ in formula (PC-1) may have. $L^1$ is preferably **—$SO_2$—*, **—$SO_2NR_N$—*, **—CO—*, **—$CONR_N$—*, or **—COO—*, more preferably, **—$SO_2$—*, **—$SO_2NR_N$—*, or **—$CONR_N$—*, and particularly preferably, **—$SO_2$—* or **—$SO_2NR_N$—*.

$R_N$ is preferably a hydrogen atom, an alkyl group, an aryl group, or a heterocyclic group, preferably a hydrogen atom, an alkyl group having 1 to 20 carbon atoms, an aryl group having 6 to 20 carbon atoms, or a heterocyclic group having 1 to 20 carbon atoms, more preferably a hydrogen atom, an alkyl group having 1 to 10 carbon atoms, an aryl group having 6 to 10 carbon atoms, or a heterocyclic group having 1 to 10 carbon atoms, and particularly preferably a hydrogen atom or an alkyl group having 1 to 6 carbon atoms.

$R^{17}$ represents one selected from a hydrogen atom, an alkyl group, an aryl group, or a heterocyclic group. In the case where $R^{17}$ represents an alkyl group, an aryl group or a heterocyclic group, these groups may be further substituted by substituents which $R^1$, $R^4$, $R^5$, $R^8$, $R^9$, $R^{12}$, $R^{13}$, or $R^{16}$ in formula (PC-1) can have. $R^{17}$ is preferably an alkyl group or an aryl group, and particularly preferably an alkyl group. $R^{17}$ has 1 to 30 carbon atoms, preferably 1 to 20 carbon atoms, and more preferably 1 to 10 carbon atoms.

$R^{17}$ is preferably substituted by a hydrophilic group. Herein, a hydrophilic group indicates a carboxy group, a sulfo group, a phosphate group, a group having a structure of quaternary salt of nitrogen, a group having a structure of quaternary salt of phosphorus, or a group in which ethylene oxy group units are repeated. In the case where the hydrophilic group is a carboxy group, a sulfo group, or a phosphate group, the hydrophilic group may have a counter cation, when necessary. As the counter cation, a metal cation, an ammonium ion, a group having a structure of quaternary salt of nitrogen, or a group having a structure of a quaternary salt of phosphorus is used.

In the case where W is a group having a structure of quaternary salt of nitrogen, or a group having a structure of quaternary salt of phosphorus, W may have a counter anion, when necessary. As examples of the counter anion, a halogen ion, a sulfate ion, a nitrate ion, a phosphate ion, an oxalate ion, an alkanesulfonate ion, an arylsulfonate ion, an alkanecarboxylate ion, an arylcarboxylate ion, and the like can be described. The hydrophilic group is preferably a carboxy group, a sulfo group, or a phosphate group, and more preferably, a carboxy group or a sulfo group. In this case, as a counter cation, $Li^+$, $Na^+$, $K^+$, $Mg^{2+}$, $Ca^{2+}$ or $NH_4^+$ is preferably used, more preferably, $Li^+$, $Na^+$, $K^+$ or $NH_4^+$ is used, and particularly preferably, $Li^+$ or $Na^+$ is used.

In formula (PC-1), when $R^1$, $R^4$, $R^5$, $R^8$, $R^9$, $R^{12}$, $R^{13}$, or $R^{16}$ is a substituent, the substituent can be a substituent selected from the same group as R, R', or R" in formula (PC-1). These substitutents may be further substituted by these substituents.

The substituents are preferably a halogen atom, an alkyl group, an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a sulfonyloxy group, an imide group, a sulfamoylamino group, a semicarbazide group, a thiosemicarbazide group, a nitro group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, or a group containing a phosphoric amide structure or a phosphate ester structure. More preferably, an alkyl group, an aryl group, a heterocyclic group, an acyl group, an alkoxycarbonyl group, a carbamoyl group, a carboxy group or a salt thereof, an oxalyl group, an oxamoyl group, a cyano group, an imide group, a sulfamoylamino group, an alkylsulfonyl group, an arylsulfonyl group, an alkylsulfinyl group, an arylsulfinyl group, a sulfo group or a salt thereof, a sulfamoyl group, an acylsulfamoyl group, or a sulfonylsulfamoyl group or a salt thereof is used.

Even more preferably, an aryl group, a heterocyclic group, an acyl group, an alkoxycarbonyl group, a carbamoyl group, a carboxy group or a salt thereof, an alkylsulfonyl group, an arylsulfonyl group, an alkylsulfinyl group, an arylsulfinyl group, a sulfo group or a salt thereof, or a sulfamoyl group is used.

In the compound represented by formula (PC-1), four or more from among $R^1$, $R^4$, $R^5$, $R^8$, $R^9$, $R^{12}$, $R^{13}$, and $R^{16}$ are preferably a group represented by formula (II), and more preferably, the compound represented by formula (PC-1) is water soluble. Further preferably, at least one of R in each combination of $R^1$ and $R^4$, $R^5$ and $R^8$, $R^9$ and $R^{12}$, and $R^{13}$ and $R^{16}$ is a group represented by formula (II). Particularly preferably, one of R in each combination of $R^1$ and $R^4$, $R^5$ and $R^8$, $R^9$ and $R^{12}$, and $R^{13}$ and $R^{16}$ is a group represented by formula (II), and the other is a hydrogen atom. When a plural number of groups represented by formula (II) are present in a same molecule, these may be identical or different from one another.

In formula (PC-1), $R^2$, $R^3$, $R^6$, $R^7$, $R^{10}$, $R^{11}$, $R^{14}$, and $R^{15}$ each independently represent a hydrogen atom or a substituent. Herein, the substituent is selected from the same range as $R^1$, $R^4$, $R^5$, $R^8$, $R^9$, $R^{12}$, $R^{13}$, and $R^{16}$ in formula (PC-1).

$R^2$, $R^3$, $R^6$, $R^7$, $R^{10}$, $R^{14}$, and $R^{15}$ are preferably a hydrogen atom, a halogen atom, a carboxy group, an alkoxycarbonyl group, an acyl group, a sulfo group, a sulfamoyl group, a sulfonyl group, an alkyl group, an aryl group, or a heterocyclic group. More preferable are a hydrogen atom, a halogen atom, a sulfo group, a sulfamoyl group, and a sulfonyl group, and particularly preferable are a hydrogen atom, a sulfo group, and a halogen atom.

Particularly preferably, in formula (PC-1), $R^2$, $R^3$, $R^6$, $R^7$, $R^{10}$, $R^{11}$, $R^{14}$, and $R^{15}$ each represent a hydrogen atom and at least one of $R^1$, $R^4$, $R^5$, $R^8$, $R^9R^{12}$, $R^{13}$ and $R^{16}$ represents a group represented by formula (II). More preferably, $R^2$, $R^3$, $R^6$, $R^7$, $R^{10}$, $R^{11}$, $R^{14}$, and $R^{15}$ each represent a hydrogen atom and four or more from among $R^1$, $R^4$, $R^5$, $R^8$, $R^9$, $R^{12}$, $R^{13}$ and $R^{16}$ represent a group represented by formula (II). Even more preferably, $R^2$, $R^2R^6$, $R^7$, $R^{10}$, $R^{11}$, $R^{14}$, and $R^{15}$ each represent a hydrogen atom, and four or more from among $R^1$, $R^4$, $R^5$, $R^8$, $R^9$, $R^{12}$, $R^{13}$ and $R^{16}$ represent a group represented by formula (II) and are a water-soluble group.

In general, compounds having a plural number of substituents may have a regioisomer, in which the substituents have different bonding positions.

The compounds represented by formula (PC-1) in the invention are not exceptional. In some cases several kinds of regioisomers may be present. In the invention, the phthalocyanine compound may be used as a single compound but it may be used as a mixture of regioisomers. In the case where a mixture of regioisomers is used, any number of regioisomers, any substitution position in the isomer, and any ratio of isomers may be employed.

SPECIFIC EXAMPLES

Examples of the compound represented by formula (PC-1) used in the present invention are shown below. However, the present invention is not limited by these examples. In the following examples of the compound, mixtures of regioisomers are described as a single compound.

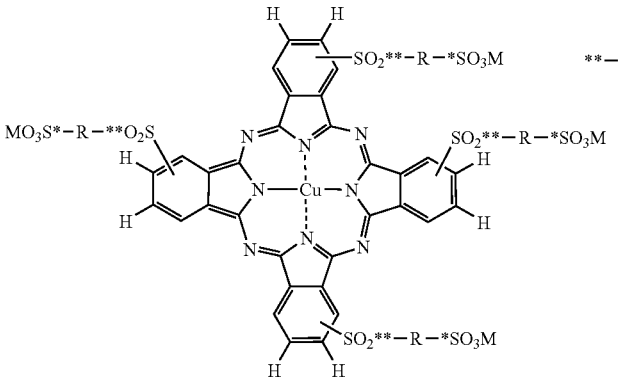

| **—R—* = | Compound No. M = Li | M = Na | M = K |
|---|---|---|---|
| **—$CH_2CH_2$—* | 1 | 10 | 19 |
| **—$CH_2CH_2CH_2$—* | 2 | 11 | 20 |
| **—$CH_2CH_2CH_2CH_2$—* | 3 | 12 | 21 |
| **—$CH_2CH_2CH_2CH_2CH_2$—* | 4 | 13 | 22 |
| **—$CH_2CH_2$-$(OCH_2CH_2)n$—* | | | |
| n = 1 | 5 | 14 | 23 |
| 2 | 6 | 15 | 24 |
| 3 | 7 | 16 | 25 |
| 4 | 8 | 17 | 26 |
| 5 | 9 | 18 | 27 |

| | Compound No. M = Li | M = Na |
|---|---|---|
| 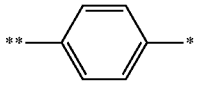 | 28 | 31 |
| 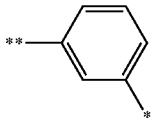 | 29 | 32 |
| 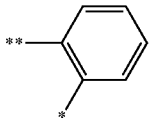 | 32 | 33 |

| | Compound No. M = Li | M = Na |
|---|---|---|
| 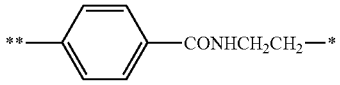 | 34 | 37 |
| 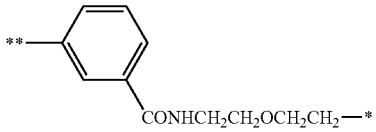 | 35 | 38 |
| 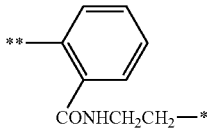 | 36 | 39 |

-continued

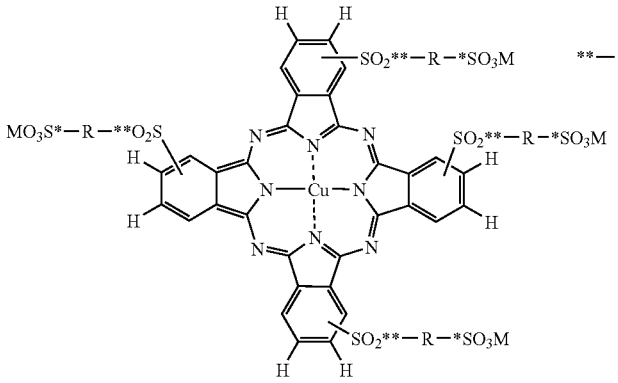

| **—R—* = | Compound No. |
|---|---|
| **—$CH_2CH_2$—* | 40 M = Li&$NH_4$ (Li/$NH_4$ = 3/1) |
| | 41 M = Li&$NH_4$ (Li/$NH_4$ = 2/2) |
| | 42 M = Na&$NH_4$ (Na/$NH_4$ = 3/1) |
| | 43 M = Na&$NH_4$ (Na/$NH_4$ = 2/2) |
| | 44 M = Na&$NH_4$ (Na/$NH_4$ = 1/3) |
| **—$CH_2CH_2CH_2$—* | 45 M = Li&$NH_4$ (Li/$NH_4$ = 3/1) |
| | 46 M = Li&$NH_4$ (Li/$NH_4$ = 2/2) |
| | 47 M = Li&$NH_4$ (Li/$NH_4$ = 1/3) |
| | 48 M = Na&$NH_4$ (Na/$NH_4$ = 3/1) |
| | 49 M = Na&$NH_4$ (Na/$NH_4$ = 2/2) |
| | 50 M = Na&$NH_4$ (Na/$NH_4$ = 1/3) |
| | 51 M = K&$NH_4$ (K/$NH_4$ = 3/1) |
| | 52 M = K&$NH_4$ (K/$NH_4$ = 2/2) |
| | 53 M = K&$NH_4$ (K/$NH_4$ = 1/3) |
| | 54 M = $Et_4N$ |
| **—$CH_2CH_2CH_2CH_2$—* | 55 M = Li&$NH_4$ (Li/$NH_4$ = 3/1) |
| | 56 M = Li&$NH_4$ (Li/$NH_4$ = 2/2) |
| | 57 M = Na&$NH_4$ (Na/$NH_4$ = 3/1) |
| | 58 M = Na&$NH_4$ (Na/$NH_4$ = 2/2) |
| | 59 M = Na&$NH_4$ (Na/$NH_4$ = 1/3) |

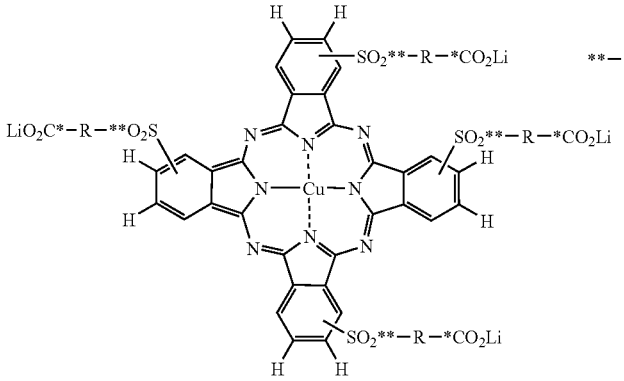

| **—R—* = | Compound No. |
|---|---|
| **—$CH_2CH_2$—* | 60 |
| **—$CH_2CH_2CH_2$—* | 61 |
| **—$CH_2CH_2CH_2CH_2$—* | 62 |
| **—$CH_2CH_2CH_2CH_2CH_2$—* | 63 |
| **—$CH_2CH_2$-$(OCH_2CH_2)n$—* | 64 |
| n = 1 | 65 |
| 2 | 66 |
| 3 | 67 |
| 4 | 68 |
| 5 | 69 |

| | Compound No. |
|---|---|
| 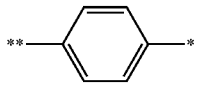 | 70 |
| 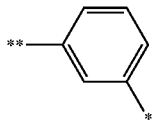 | 71 |
| 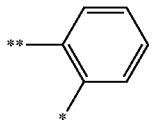 | 72 |

| | Compound No. |
|---|---|
| 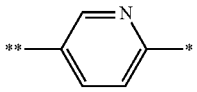 | 73 |
| 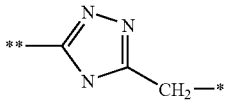 | 74 |
| 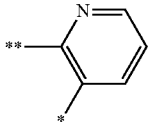 | 75 |

-continued
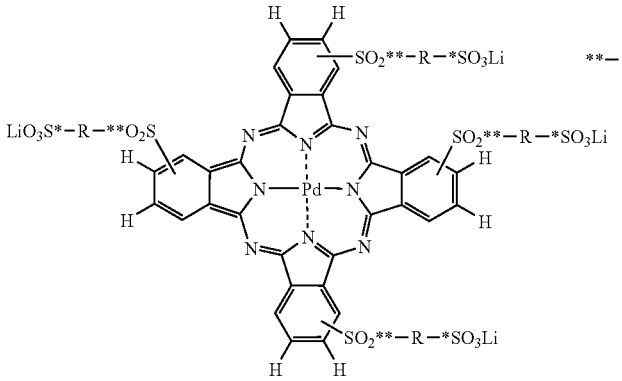
| **—R—* = | Compound No. |
|---|---|
| **—$CH_2CH_2$—* | 76 |
| **—$CH_2CH_2CH_2$—* | 77 |
| **—$CH_2CH_2CH_2CH_2$—* | 78 |
| **—$CH_2CH_2CH_2CH_2CH_2$—* | 79 |
| **—$CH_2CH_2CH_2CH_2CH_2CH_2$—* | |
| **—$CH_2CH_2$-$(OCH_2CH_2)n$—* | |
| n = 1 | 80 |
| 2 | 81 |
| 3 | 82 |
| 4 | 83 |
| 5 | 84 |
| | Compound No. |
|---|---|
| 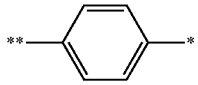 | 85 |
| 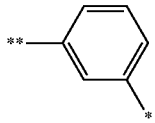 | 86 |
| 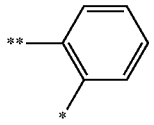 | 87 |
| | Compound No. |
|---|---|
| 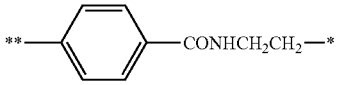 | 88 |
| 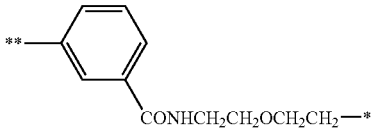 | 89 |
| 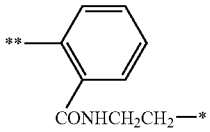 | 90 |
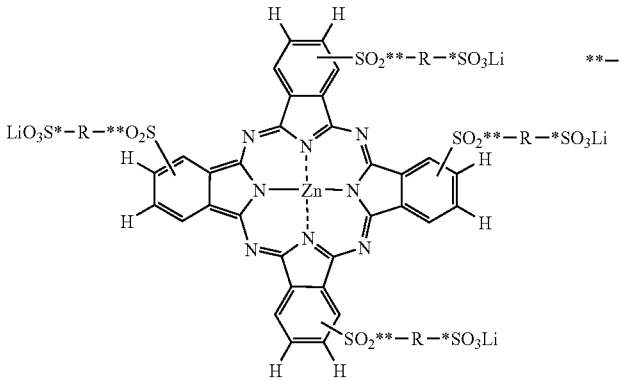
| **—R—* = | Compound No. |
|---|---|
| **—$CH_2CH_2$—* | 91 |
| **—$CH_2CH_2CH_2$—* | 92 |
| **—$CH_2CH_2CH_2CH_2$—* | 93 |
| **—$CH_2CH_2CH_2CH_2CH_2$—* | 94 |
| **—$CH_2CH_2CH_2CH_2CH_2CH_2$—* | |
| **—$CH_2CH_2$-$(OCH_2CH_2)n$—* | |
| n = 1 | 95 |
| 2 | 96 |
| 3 | 97 |
| 4 | 98 |
| 5 | 99 |

-continued
| Compound No. | | Compound No. | |
|---|---|---|---|
| 100 | 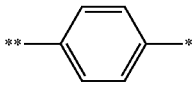 | 103 | 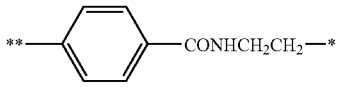 |
| 101 | 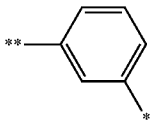 | 104 | 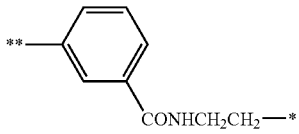 |
| 102 | 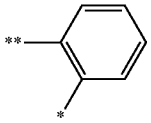 | 105 | 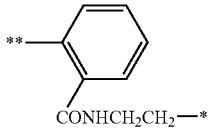 |
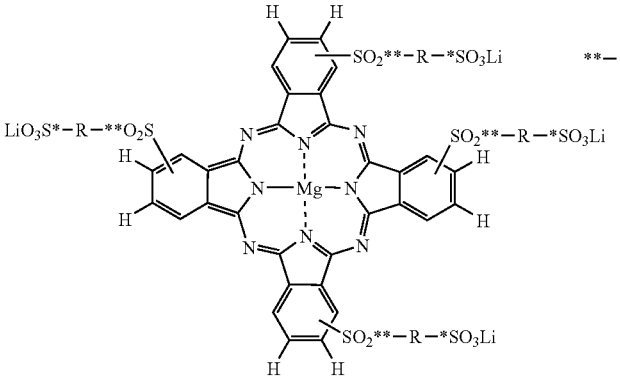
| **—R—* = | Compound No. |
|---|---|
| **—$CH_2CH_2$—* | 106 |
| **—$CH_2CH_2CH_2$—* | 107 |
| **—$CH_2CH_2CH_2CH_2$—* | 108 |
| **—$CH_2CH_2CH_2CH_2CH_2$—* | 109 |
| **—$CH_2CH_2$-$(OCH_2CH_2)n$—* | |
| n = 1 | 110 |
| 2 | 111 |
| 3 | 112 |
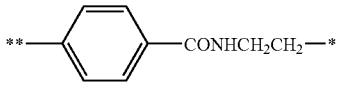
113
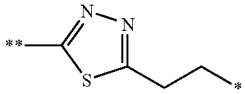
114
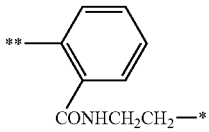
115
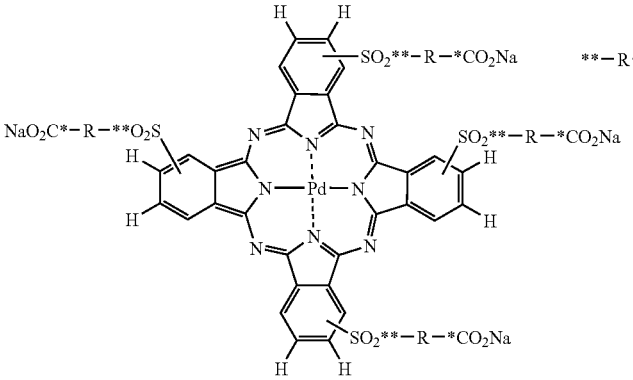
| **—R—* = | Compound No. |
|---|---|
| **—$CH_2CH_2$—* | 116 |
| **—$CH_2CH_2CH_2$—* | 117 |
| **—$CH_2CH_2CH_2CH_2$—* | 118 |
| **—$CH_2CH_2CH_2CH_2CH_2$—* | |
| **—$CH_2CH_2$-$(OCH_2CH_2)n$—* | |
| n = 1 | 119 |
| 2 | 120 |
| 3 | 121 |

-continued
| | Compound No. | | Compound No. |
|---|---|---|---|
| 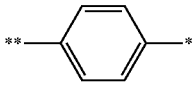 | 122 | 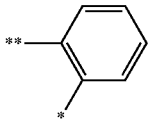 | 124 |
| 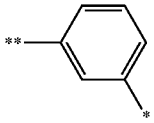 | 123 | 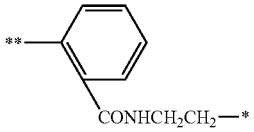 | 125 |
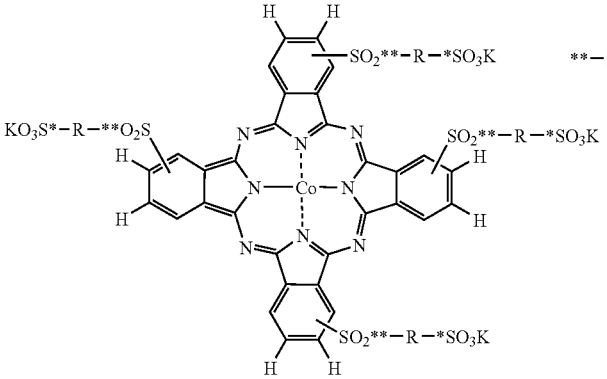
| **—R—* = | Compound No. |
|---|---|
| **—$CH_2CH_2$—* | 126 |
| **—$CH_2CH_2CH_2$—* | 127 |
| **—$CH_2CH_2CH_2CH_2$—* | 128 |
| **—$CH_2CH_2CH_2CH_2CH_2$—* | |
| **—$CH_2CH_2$-$(OCH_2CH_2)n$—* | |
| n = 1 | 129 |
| 2 | 130 |
| 3 | 131 |
| | Compound No. | | Compound No. |
|---|---|---|---|
| 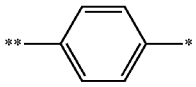 | 132 | 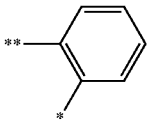 | 134 |
| 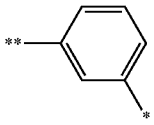 | 133 | 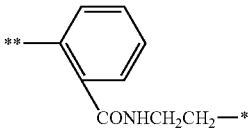 | 135 |
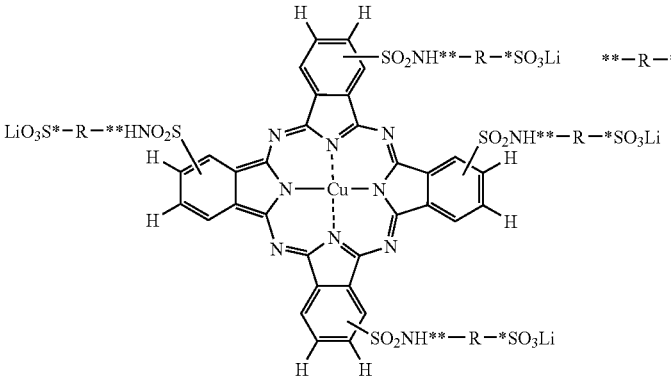
| **—R—* = | Compound No. |
|---|---|
| **—$CH_2CH_2$—* | 136 |
| **—$CH_2CH_2CH_2$—* | 137 |
| **—$CH_2CH_2CH_2CH_2$—* | 138 |
| **—$CH_2CH_2CH_2CH_2CH_2$—* | 139 |
| **—$CH_2CH_2$-$(OCH_2CH_2)n$—* | |
| n = 1 | 140 |
| 2 | 141 |
| 3 | 142 |

-continued
| | Compound No. | | Compound No. |
|---|---|---|---|
| 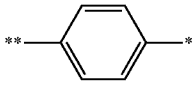 | 143 | 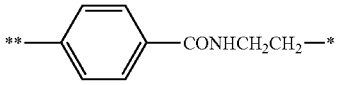 | 146 |
| 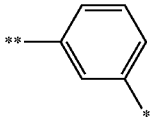 | 144 | 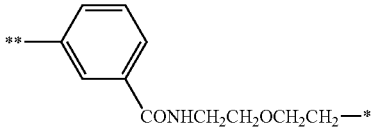 | 147 |
| 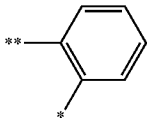 | 145 | 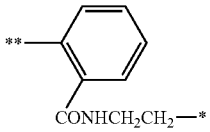 | 148 |
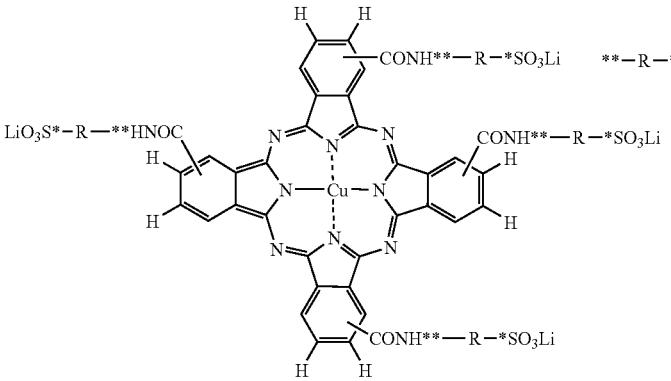
| **—R—* = | Compound No. |
|---|---|
| **—$CH_2CH_2$—* | 149 |
| **—$CH_2CH_2CH_2$—* | 150 |
| **—$CH_2CH_2CH_2CH_2$—* | 151 |
| **—$CH_2CH_2CH_2CH_2CH_2$—* | 152 |
| **—$CH_2CH_2$-$(OCH_2CH_2)n$—* | |
| n = 1 | 153 |
| 2 | 154 |
| 3 | 155 |
| | Compound No. | | Compound No. |
|---|---|---|---|
| 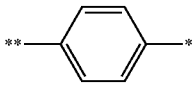 | 156 | 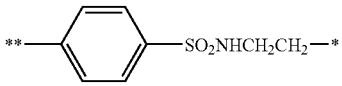 | 159 |
| 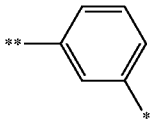 | 157 | 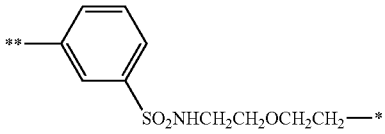 | 161 |
| 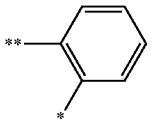 | 158 | 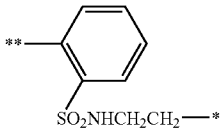 | 162 |

-continued
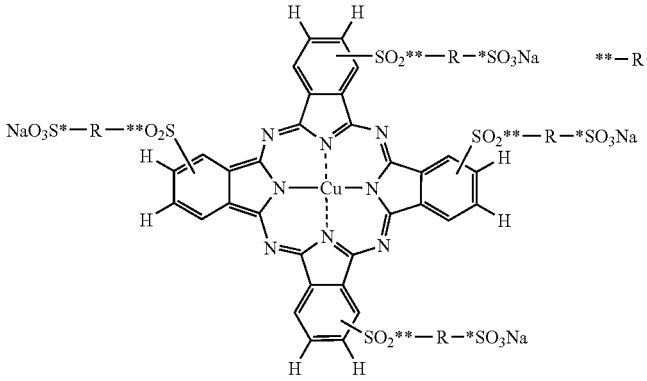
| **—R—* = | Compound No. |
|---|---|
| **—$CH_2CH_2$—* | 163 |
| **—$CH_2CH_2CH_2$—* | 164 |
| **—$CH_2CH_2CH_2CH_2$—* | 165 |
| **—$CH_2CH_2CH_2CH_2CH_2$—* | |
| **—$CH_2CH_2$—$(OCH_2CH_2)n$—* | |
| n = 1 | 166 |
| 2 | 167 |
| 3 | 168 |
| | Compound No. |
|---|---|
| 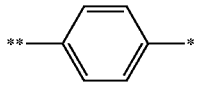 | 169 |
| 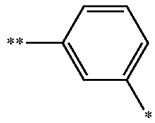 | 170 |
| | Compound No. |
|---|---|
| 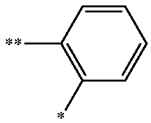 | 171 |
| 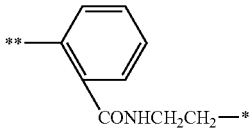 | 172 |
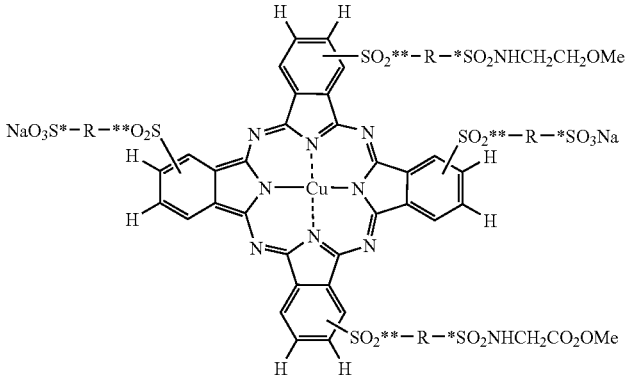
| **—R—* = | Compound No. |
|---|---|
| **—$CH_2CH_2$—* | 173 |
| **—$CH_2CH_2CH_2$—* | 174 |
| **—$CH_2CH_2CH_2CH_2$—* | 175 |
| **—$CH_2CH_2CH_2CH_2CH_2$—* | |
| **—$CH_2CH_2$—$(OCH_2CH_2)n$—* | |
| n = 1 | 176 |
| 2 | 177 |
| 3 | 178 |
| | |
|---|---|
| 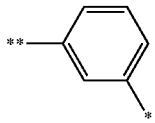 | 179 |
| 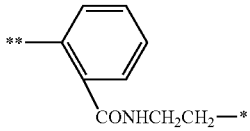 | 180 |

-continued
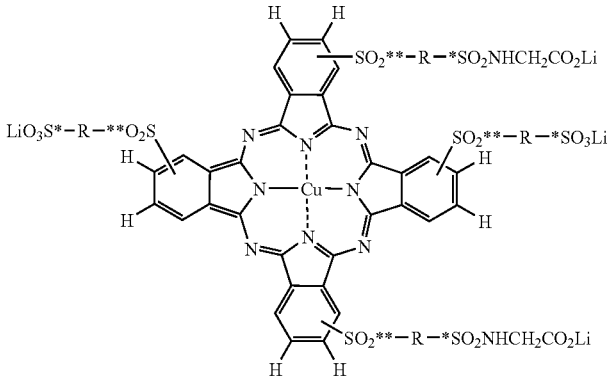
| | Compound No. |
|---|---|
| **−R−* = **−$CH_2CH_2$−* | 181 |
| **−$CH_2CH_2CH_2$−* | 182 |
| **−$CH_2CH_2CH_2CH_2$−* | 183 |
| **−$CH_2CH_2CH_2CH_2CH_2$−* | |
| **−$CH_2CH_2$−$(OCH_2CH_2)n$−* | |
| n = 1 | 184 |
| 2 | 185 |
| 3 | 186 |
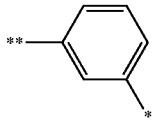
187
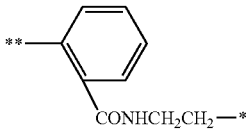
188
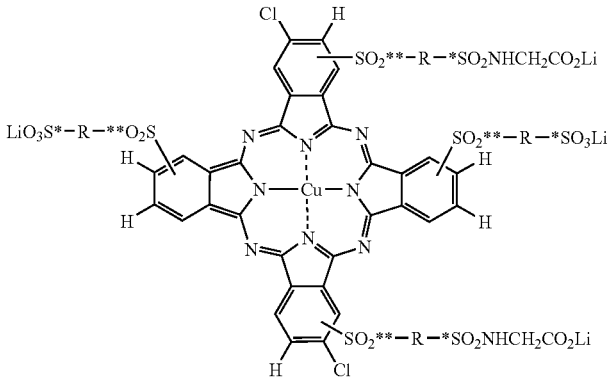
| | Compound No. |
|---|---|
| **−R−* = **−$CH_2CH_2CH_2$−* | 189 |
| **−$CH_2CH_2CH_2CH_2$−* | 190 |
| **−$CH_2CH_2CH_2CH_2CH_2$−* | 191 |
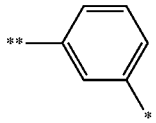
192
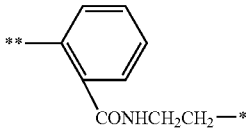
193
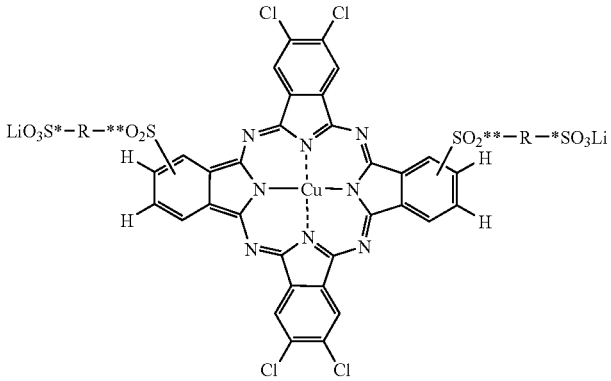
| | Compound No. |
|---|---|
| **−R−* = **−$CH_2CH_2CH_2$−* | 194 |
| **−$CH_2CH_2CH_2CH_2$−* | 195 |
| **−$CH_2CH_2CH_2CH_2CH_2$−* | 196 |
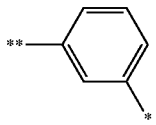
197
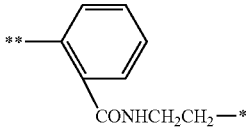
198

-continued
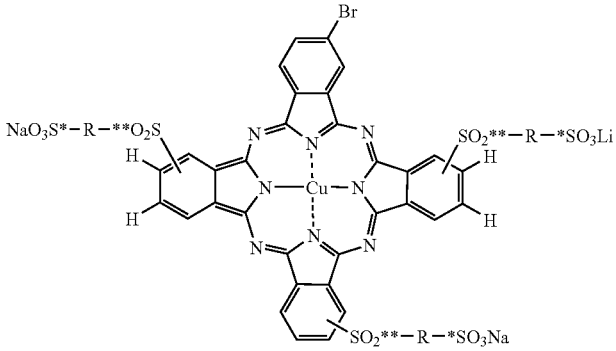
| **—R—* = | Compound No. |
|---|---|
| **—$CH_2CH_2CH_2$—* | 199 |
| **—$CH_2CH_2CH_2CH_2$—* | 200 |
| **—$CH_2CH_2CH_2CH_2CH_2$—* | 201 |
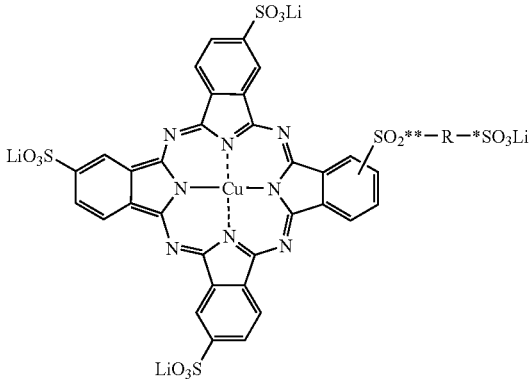
| **—R—* = | Compound No. |
|---|---|
| **—$CH_2CH_2CH_2$—* | 202 |
| **—$CH_2CH_2CH_2CH_2$—* | 203 |
| **—$CH_2CH_2CH_2CH_2CH_2$—* | 204 |
| 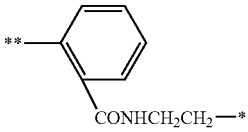 | 205 |
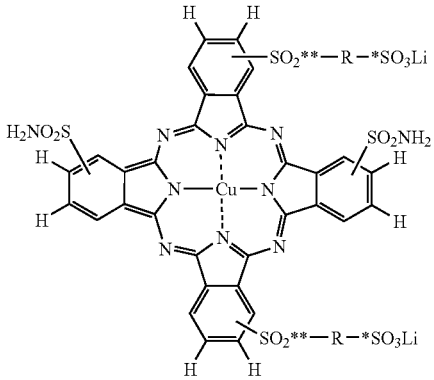
| **—R—* = | Compound No. |
|---|---|
| **—$CH_2CH_2$—* | 206 |
| **—$CH_2CH_2CH_2$—* | 207 |
| **—$CH_2CH_2CH_2CH_2$—* | 208 |
| **—$CH_2CH_2CH_2CH_2CH_2$—* | 209 |
| **—$CH_2CH_2$-$(OCH_2CH_2)n$—* | |
| n = 1 | 210 |
| 2 | 211 |
| 3 | 212 |
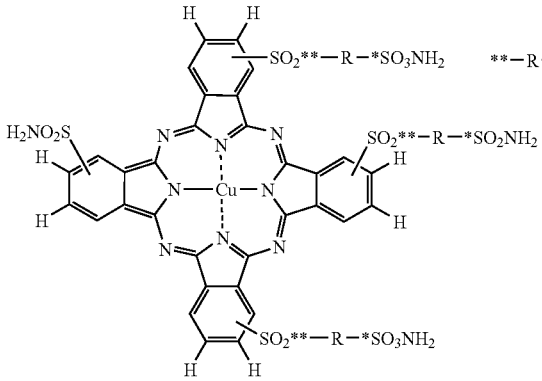
| **—R—* = | Compound No. |
|---|---|
| **—$CH_2CH_2$—* | 213 |
| **—$CH_2CH_2CH_2$—* | 214 |
| **—$CH_2CH_2CH_2CH_2$—* | 215 |
| **—$CH_2CH_2CH_2CH_2CH_2$—* | 216 |
| **—$CH_2CH_2$-$(OCH_2CH_2)n$—* | |
| n = 1 | 217 |
| 2 | 218 |
| 3 | 219 |

<Synthesis of Illustrated Compound No. 2>

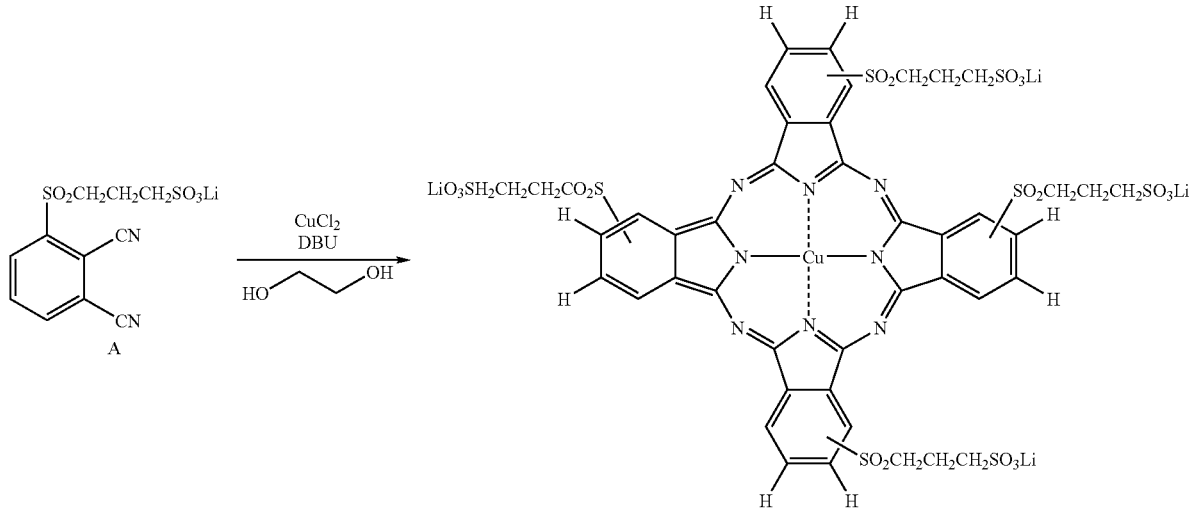

Illustrated compound No. 2

$CuCl_2$ (134 mg, 1 mmol) was added to a synthetic intermediate A (1.26 g, 4 mmol) in an ethylene glycol solution (10 mL), and this was heated to 100° C. DBU (1.52 g, 10 mmol) was added to the reaction mixture, and stirring was carried out for 10 hours at 100° C. The reaction mixture was acidified with hydrochloric acid, and LiCl was added thereto to separate a crude phthalocyanine. The obtained crude product was purified through column chromatography using Sephadex G-15 as a carrier. 67 mg of a mixture of illustrated compound No. 2 was obtained (yield of 5%).

<Adding Method of Dye>

The dye of the invention is preferably water-soluble and is preferably used for the manufacturing of photothermographic material as an aqueous solution prepared in advance by water as a medium. In the said solution, the water-soluble phthalocyanine compound of the present invention is contained in an amount of from 0.1% by weight to 30% by weight, preferably from 0.5% by weight to 20% by weight, and more preferably from 1% by weight to 8% by weight. The said solution further may contain a water-soluble organic solvent or an auxiliary additive. A content of water-soluble organic solvent is from 0% by weight to 30% by weight, and preferably from 5% by weight to 30% by weight. A content of auxiliary additive is from 0% by weight to 5% by weight, and preferably from 0% by weight to 2% by weight.

At the preparation of an aqueous solution of water-soluble phthalocyanine compound according to the present invention, as specific examples of the usable water-soluble organic solvent, alkanol having 1 to 4 carbon atoms such as methanol, ethanol, propanol, isopropanol, butanol, isobutanol, sec-butanol, tert-butanol, or the like; amide carboxylate such as N,N-dimethlyformamide, N,N-dimethylacetamide, or the like; lactams such as ϵ-caprolactam, N-methylpirrolidine-2-one, or the like; urea; a cyclic urea such as 1,3-dimethylimidazolidine-2-one, 1,3-dimethylhexahydropyrimide-2-one, or the like; ketone or ketoalcohol such as acetone, methyl ethyl ketone, 2-methyl-2-hydroxypentane-4-one, or the like; ether such as tertahydrofuran, dioxan, or the like; mono-, oligo-, and polyalkylene glycol or thioglycol having an alkylene unit with 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol, or the like; polyol (triol) such as glycerine, hexane-1,2,6-triol, or the like; alkylether with 1 to 4 carbon atoms of poly-alcohol such as ethylene glycol monomethylether, ethylene glycol monoethylether, diethylene glycol monomethylether, diethylene glycol monoethylether, triethylene glycol monomethylether, triethylene glycol monoethylether, or the like; γ-butylolactone, dimethylsulfoxide, and the like can be described. Two or more of these water-soluble organic solvents can be used in combination.

Among the water-soluble organic solvents described above, urea, N-methylpyrrolidine-2-one, mono, di, or trialkylene glycol having an alkylene unit with 2 to 6 carbon atoms are preferable, and mono, di, or triethylene glycol, dipropylene glycol, dimethylsulfoxide, and the like are more preferable. Particularly, N-methlpyrrolidine-2-one, diethylene glycol, dimethysulfoxide, or urea is preferably used, and urea is most preferable. As the water-soluble phthalocyanine compound of the invention is diluted by mixing the said aqueous solution with various chemicals at the making of photothermographic material, the method of containing an water-soluble organic solvent, besides the said aqueous solution, in an amount of from 1 mol to 500 mol per 1 mol of the water-soluble dye is also preferably applied.

Examples of the auxiliary additives include an antiseptic, a pH control agent, a chelating agent, a rust-preventing agent, a water-soluble ultraviolet ray absorbing agent, a water-soluble polymer, a dye solvent, a surfactant, and the like, and they are added if necessary.

Examples of the antiseptic include sodium dihydroacetate, sodium sorbinate, sodium 2-pyridinethiol-1-oxide, sodium benzoate, sodium pentachloro phenol, benzisothiazolinone and a salt thereof, p-hydroxybenzoic acid esters, and the like.

As the pH control agent, any compounds can be applied as far as it can control the pH of the prepared solution in a range of from 4 to 11 without any bad effect. Examples of the pH control agent include alkanolamine such as diethanolamine or triethanol amine; alkali metal salts of hydroxide such as lithium hydroxide, sodium hydroxide, or potassium hydroxide; ammonium hydroxide; and alkali metal salts of carbonic acid such as lithium carbonate, sodium carbonate, or potassium carbonate.

Examples of the chelating agent include a sodium salt of ethylenediaminetetraacetic acid, a sodium salt of nitrilotriacetic acid, a sodium salt of hydroxyethyl ethylenediaminetriacetic acid, a sodium salt of diethylene triaminepentaacetic acid, a sodium salt of uracil diacetic acid, and the like. Examples of the rust-preventing agent include hyposulfites, sodium thiosulfate, thioglycolic acid ammonium salt, diisopropyl ammonium nitrite, pentaerythrithol tetranitrate, dicyclohexylammonium nitrite, and the like. Examples of the water-soluble polymer include poly(vinyl alcohol), a cellulose derivative, polyamine, polyimine, and the like. Examples of the water-soluble ultraviolet ray absorbing agent include a sulfonated benzophenone, a sulfonated benztriazole, and the like. Examples of the dye solvent include ϵ-caprolactam, ethylene carbonate, urea, and the like. Examples of the surfactant include well-known surfactants of anionic, cationic, and nonionic surfactants, and a surfactant of acetyleneglycol type or the like is also preferably used.

<Layer to be Added>

The dye of the present invention can be incorporated in at least one layer on the side of the support where an image forming layer is provided, or in at least one layer provided on the opposite side of the support from the side where an image forming layer is provided. The dye can be incorporated on both sides of the support.

<Range of Addition Amount>

To adjust the image tone after thermal developing process in a preferable level, the addition amount of dye is determined by the combination with a color tone of developed silver image or a color tone obtained by other additives. Generally, the dye is used at an amount as such that the optical density does not exceed 1.5 when measured at the desired wavelength. The optical density is from 0.01 to 1.2, preferably from 0.05 to 1.0, and more preferably from 0.1 to 0.8. To obtain the above optical density, the addition amount of dye is generally from 0.5 mg/m$^2$ to 200 mg/m$^2$, preferably from 1 mg/m$^2$ to 160 mg/m 2, and more preferably from 5 mg/m$^2$ to 120 mg/m$^2$.

(Reducing Agent)

The photothermographic material of the present invention preferably contains a reducing agent for organic silver salts as a thermal developing agent. The reducing agent for organic silver salts can be any substance (preferably, organic substance) capable of reducing silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

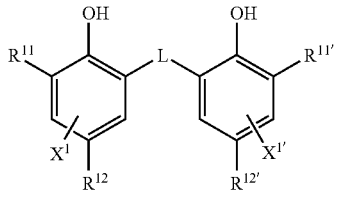

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

In the following description, when referred to as an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^1$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more reducing agents in combination, it is preferred to use two or more reducing agents in combination depending on the purpose.

Specific examples of the reducing agents of the invention including the compounds represented by formula (R) according to the invention are shown below, but the invention is not restricted to these.

R-1

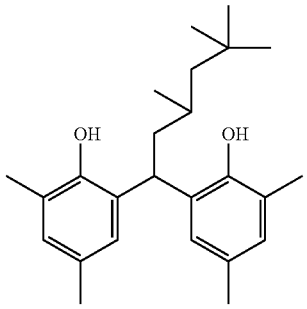

R-2

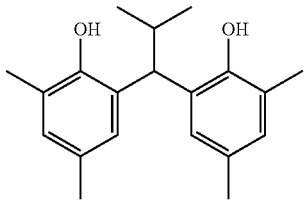

R-3

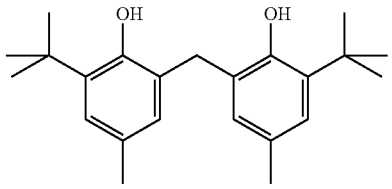

R-4

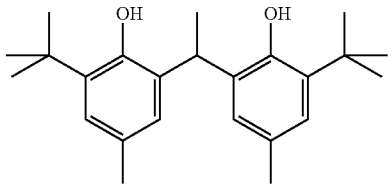

R-5

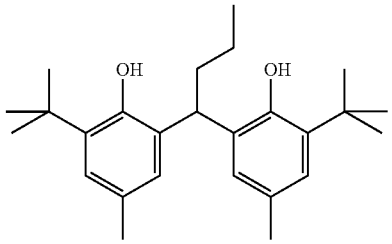

R-6

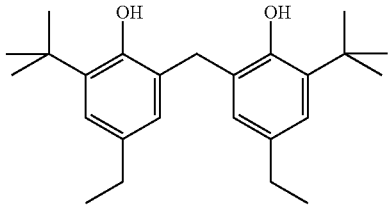

R-7

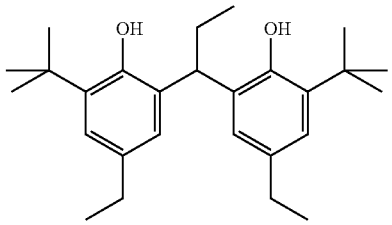

-continued

R-8

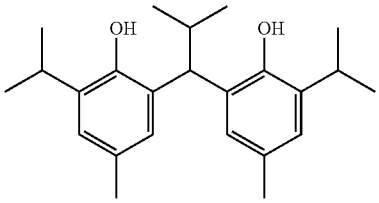

R-9

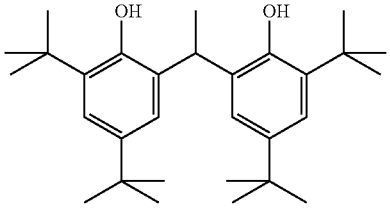

R-10

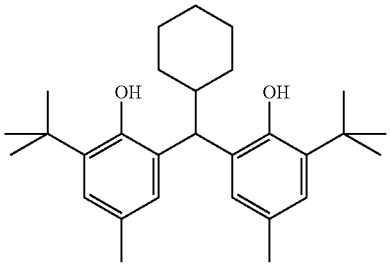

R-11

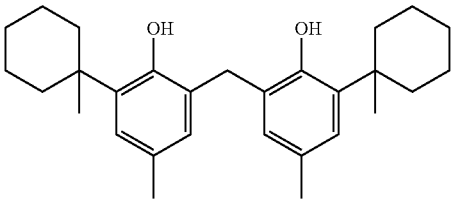

R-12

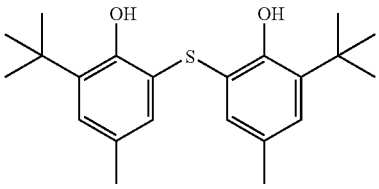

R-13

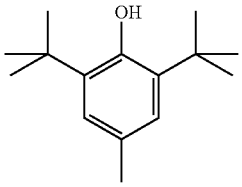

R-14

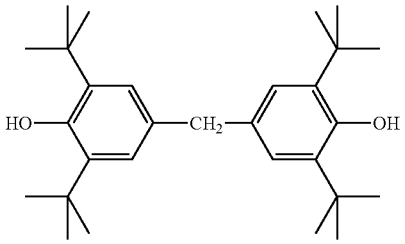

-continued

R-15

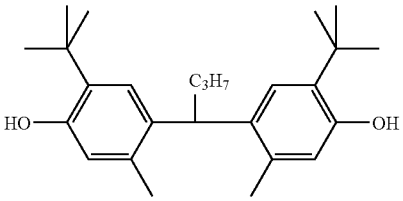

R-16

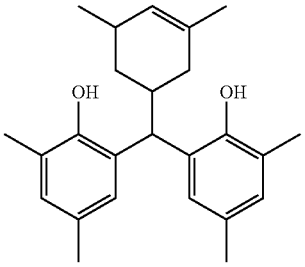

R-17

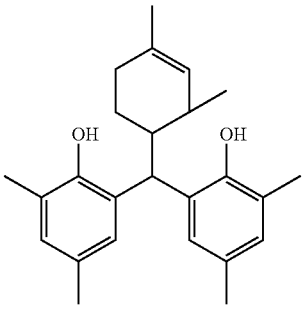

R-18

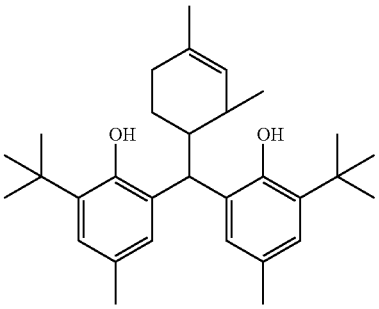

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the reducing agent in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As a solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a high boiling solvent which is solid at a normal temperature and an auxiliary solvent having a low boiling point, or to add as a so-called oilless emulsified dispersion not using the high boiling solvent.

In the present invention, among the development accelerators described above, hydrazine compounds represented by formula (D) described in the specification of JP-A No. 2002-156727, and phenolic or naphtholic compounds represented by formula (2) described in the specification of JP-A No. 2001-264929 are more preferred.

Particularly preferred development accelerators of the invention are compounds represented by the following formulae (A-1) or (A-2).

$Q_1$-NHNH-$Q_2$ Formula (A-1)

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from one another. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, such substituents may be identical or different from one another.

Next, preferred, range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are more preferred. Further, $Q_2$ is preferably a carbamoyl group and, particularly, a carbamoyl group having a hydrogen atom on the nitrogen atom is particularly preferred.

Formula (A-2)

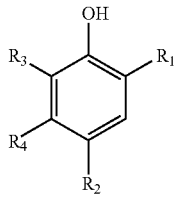

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

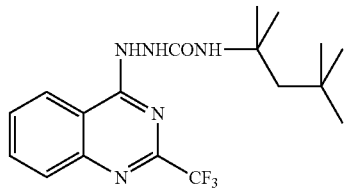

A-2

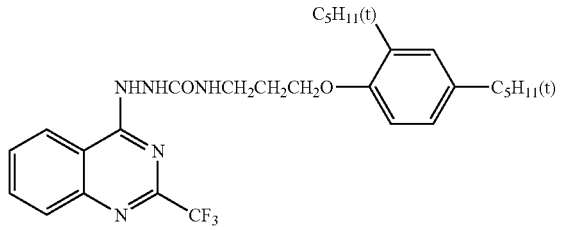

A-3

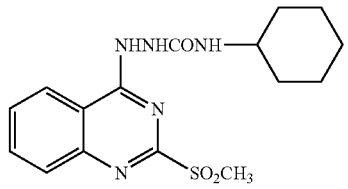

-continued

A-4

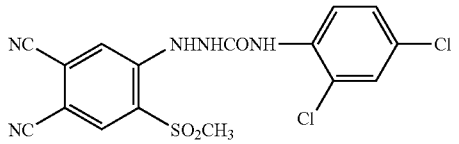

A-5

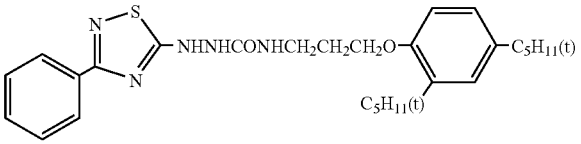

A-6

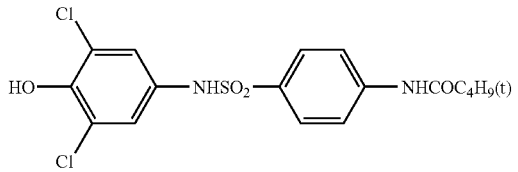

A-7

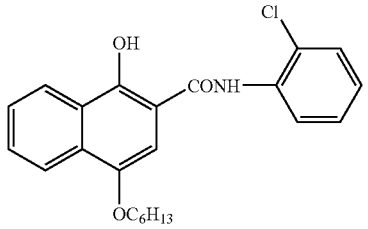

A-8

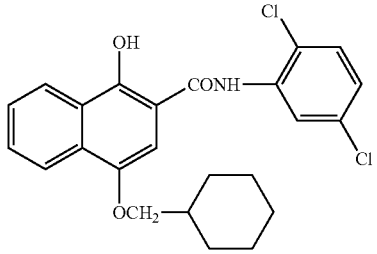

A-9

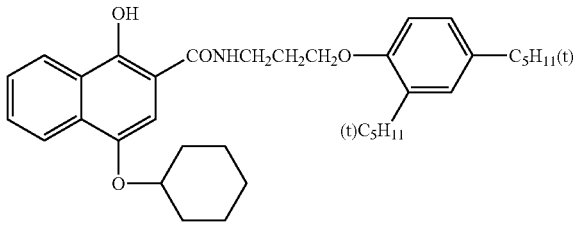

A-10

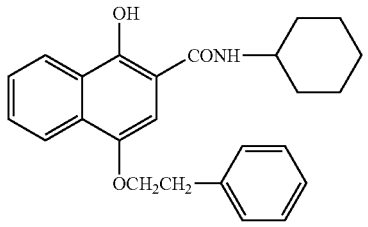

-continued

A-11

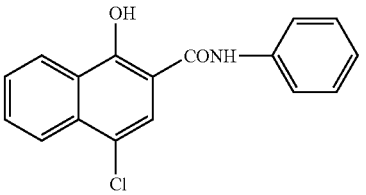

A-12

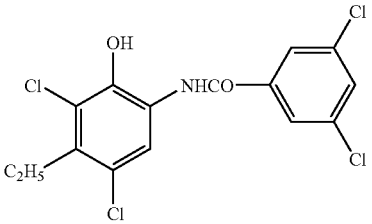

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group reacting with these groups of the reducing agent, and also forming a hydrogen bond therewith.

As a group forming a hydrogen bond with a hydroxy group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound expressed by formula (D) shown below.

Formula (D)

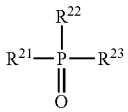

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others are shown below, but the invention is not limited thereto.

D-1

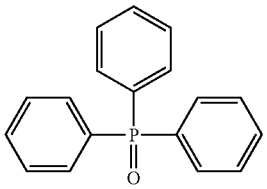

D-2

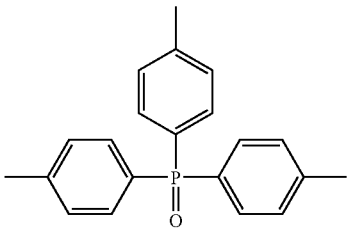

-continued

D-3

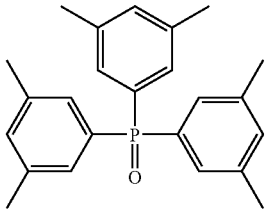

D-4

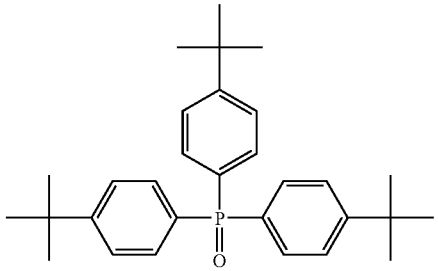

D-5

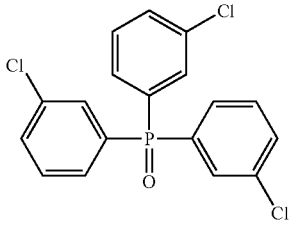

D-6

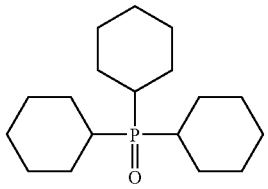

D-7

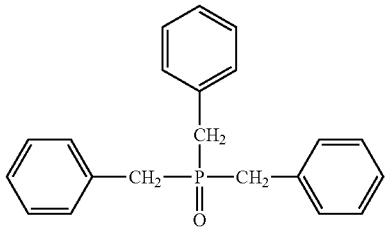

D-8

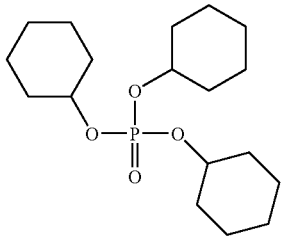

D-9

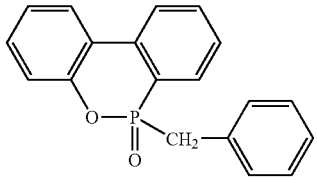

-continued

D-10

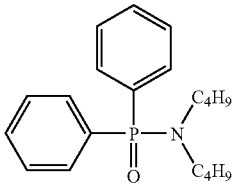

D-11

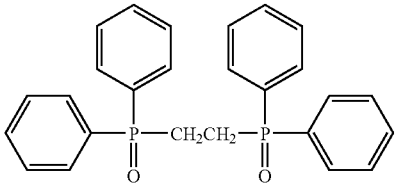

D-12

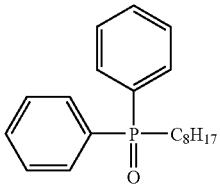

D-13

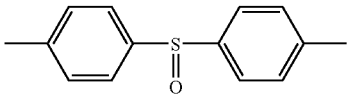

D-14

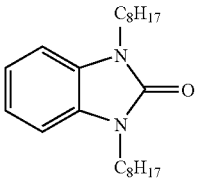

D-15

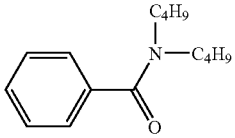

Specific examples of hydrogen bonding compounds other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, in a range of from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

4) Grain Shape

The shape of the silver halide grain can include, for example, cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 1-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$-$[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl)ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron(II) silver salt is a less soluble salt than AgI, redissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained in the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306. The sensitizing dyes described above may be used alone or two or more of them may be used in combination. In the invention, sensitizing dye can be added preferably after a desalting step and before coating, and more preferably after a desalting step and before the completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and $10^{-111543}$, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of sulfur, selenium, or tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-Electron-Oxidized to Provide a One-Electron Oxidation Product which Releases One or More Electrons The photothermographic material of the invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound is be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). And the preferable ranges of these compounds are the same as the preferable ranges described in the quoted specifications.

Formula (1)

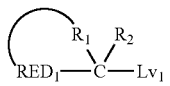

Formula (2)

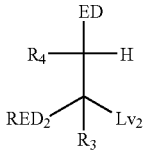

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5- or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

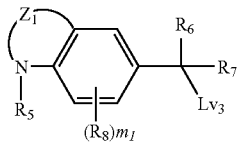

-continued

Formula (4)

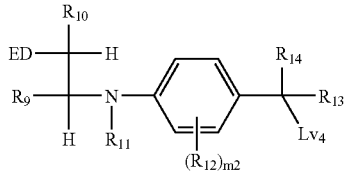

Formula (5)

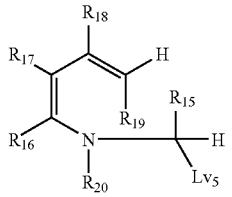

In formulae (3), (4), and (5), Z, represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

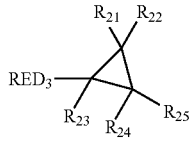

Formula (7)

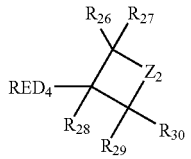

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

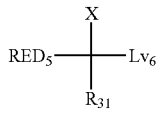

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

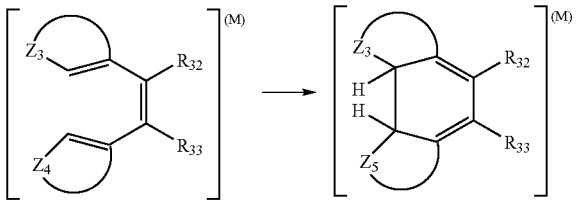

Formula (9)

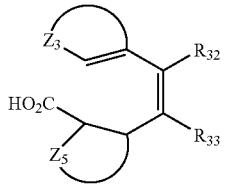

The compound represented by formula (9) is a compound that undergoes a bonding reaction represented by reaction formula (I) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5- or 6-membered heterocycle with C═C. $Z_4$ represents a group to form a 5- or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5- or 6-membered cyclic aliphatic hydrocarbon group or heterocyclic group with C—C.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

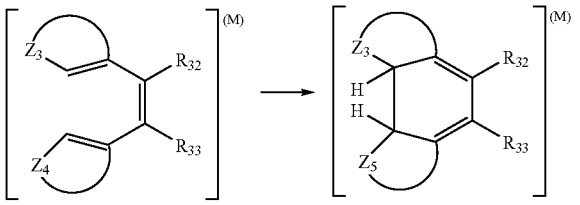

Formula (11)

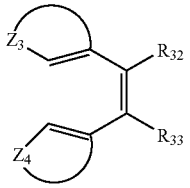

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5- or 6-membered heterocycle with C═C. $Z_4$ represents a group to form a 5- or 6-membered aryl group or heterocyclic group with C═C. $Z_5$ represents a group to form a 5- or 6-membered cyclic aliphatic hydrocarbon group or heterocyclic group with C—C. M represents one selected from a radical, a radical cation, and a cation. In formula (II), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH-group as a partial structure of heterocycle capable to form a silver imidate (—N(Ag)—) (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

$$(P\text{-}Q_1\text{-})_i\text{—}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound Having Adsorptive Group and Reducing Group

The photothermographic material of the present invention preferably comprises a compound having an adsorptive group to silver halide and a reducing group in a molecule. It is preferred that the compound is represented by the following formula (I).

$$A\text{-}(W)n\text{-}B \qquad \text{Formula (I)}$$

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also includes a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (—N(Ag)—) or a heterocyclic group, having an —S— group, a —Se— group, a —Te— group or a ═N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (1), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (—N(Ag)—) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), a reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.

(1)

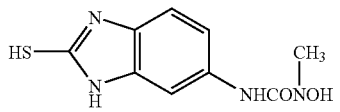

-continued (2)

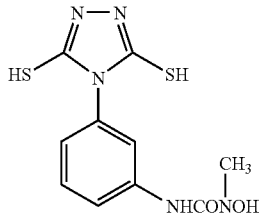

(3)

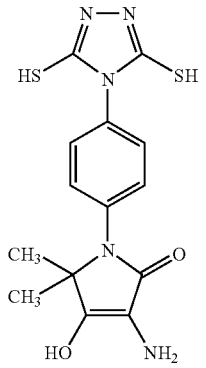

(4)

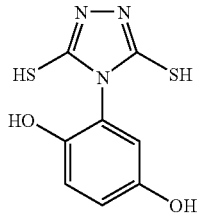

(5)

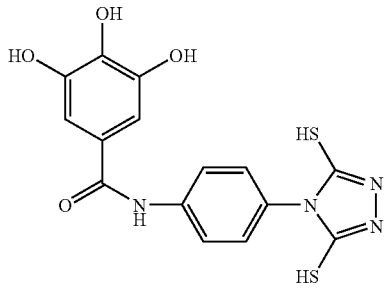

(6)

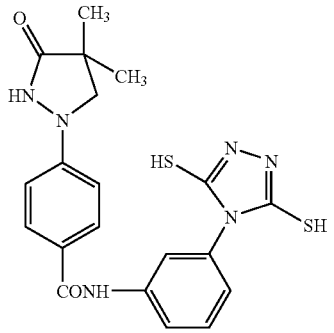

-continued (7)

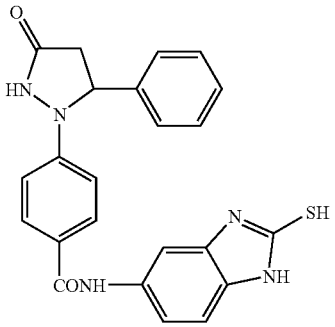

(8)

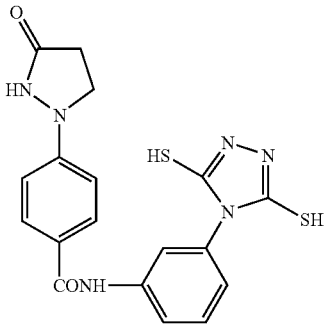

(9)

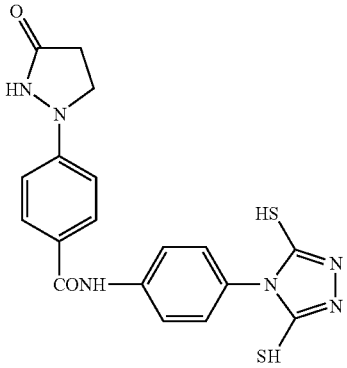

(10)

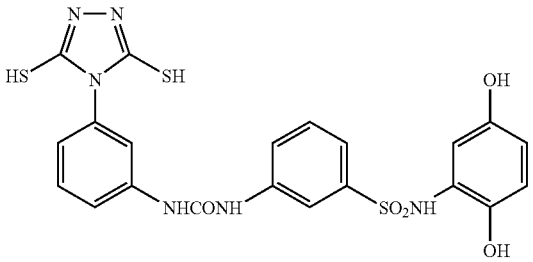

(11)

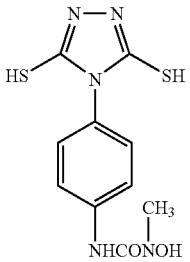

-continued (12)

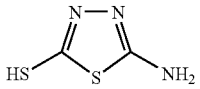

(13)

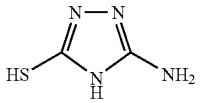

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (I) according to the present invention can be used alone, but it is preferred to use two or more of the compounds in combination. When two or more of the compounds are used in combination, those may be added to the same layer or the different layers, whereby adding methods may be different from one another.

The compound represented by formula (I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of a Plurality of Silver Halides

The photosensitive silver halide emulsion in the photothermographic material used in the invention may be used alone, or two or more of them (for example, those of different average particle sizes, different halogen compositions, of different crystal habits and of different conditions for chemical sensitization) may be used together. Gradation can be controlled by using plural photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, most preferably, from 0.07 $g/m^2$ to 0.3 $g/m^2$. The photosensitive silver halide is used in a range of from 0.01 mol to 0.5 mol, preferably, from 0.02 mol to 0.3 mol, and even more preferably from 0.03 mol to 0.2 mol, per 1 mol of the organic silver salt.

13) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Preferable organic polyhalogen compound that is used in the invention is explained specifically below. In the invention, preferred organic polyhalogen compound is the compound expressed by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an aryl group, or a heterocyclic group.

In formula (H), in the case where Q is a heterocyclic group, Q is preferably a nitrogen-containing heterocyclic group having 1 or 2 nitrogen atoms, and particularly preferably a 2-pyridyl group or a 2-quinolyl group.

In formula (H), in the case where Q is an aryl group, Q preferably is a phenyl group substituted by an electron-attracting group whose Hammett substituent coefficient σ p yields a positive value. For the details of Hammett substituent coefficient, reference can be made to Journal of Medicinal Chemistry, vol. 16, No. 11 (1973), pp. 1207 to 1216, and the like. As such electron-attracting group, examples include, halogen atoms (fluorine atom (σ p value: 0.06), chlorine atom (σ p value: 0.23), bromine atom (a p value: 0.23), iodine atom (σ p value: 0.18)), trihalomethyl groups (tribromomethyl (σ p value: 0.29), trichloromethyl (σ p value: 0.33), trifluoromethyl (σ p value: 0.54)), a cyano group (σ p value: 0.66), a nitro group (σ p value: 0.78), an aliphatic aryl sulfonyl group or a heterocyclic sulfonyl group (for example, methanesulfonyl (σ p value: 0.72)), an aliphatic aryl acyl group or a heterocyclic acyl group (for example, acetyl (σ p value: 0.50) and benzoyl (σ p value: 0.43)), an alkynyl (e.g., C═CH (σ p value: 0.23)), an aliphatic aryl oxycarbonyl group or a heterocyclic oxycarbonyl group (for example, methoxycarbonyl (σ p value: 0.45) and phenoxycarbonyl (σ p value: 0.44)), a carbamoyl group (σ p value: 0.36), a sulfamoyl group (σ p value: 0.57), a sulfoxido group, a heterocyclic a group, a phosphoryl group, and the like. Preferred range of the a p value is from 0.2 to 2.0, and more preferably, from 0.4 to 1.0. Particularly preferred as the electron-attracting groups are a carbamoyl group, an alkoxycarbonyl group, an alkylsulfonyl group, and an alkylphosphoryl group, and most preferred among them is a carbamoyl group.

X is preferably an electron-attracting group, and more preferably, a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, or a sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. n represents 0 or 1, and preferably represents 1.

Specific examples of the compounds expressed by formula (H) of the invention are shown below.

H-1

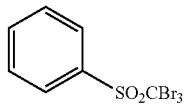

-continued

H-2

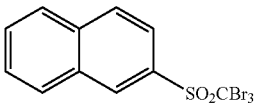

H-3

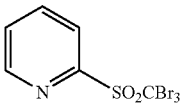

H-4

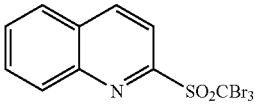

H-5

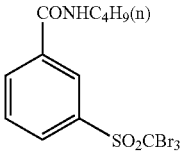

H-6

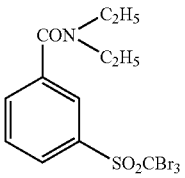

H-7

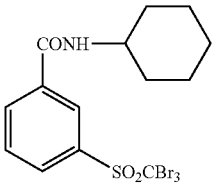

H-8

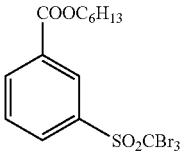

H-9

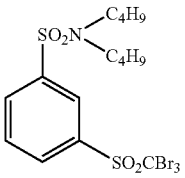

H-10

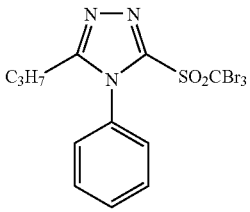

-continued

H-11

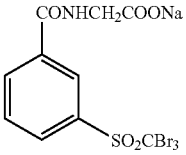

H-12

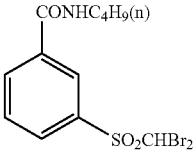

H-13

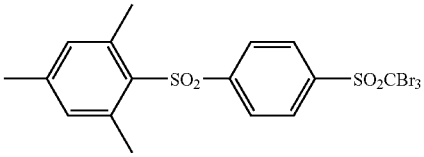

H-14

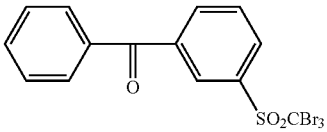

H-15

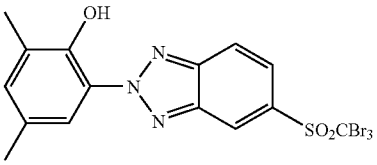

As preferred organic polyhalogen compounds of the invention other than those above, there can be mentioned compounds disclosed in JP-A Nos. 2001-31644, 2001-56526, and 2001-209145.

The coating amount of the organic polyhalogen compound is preferably in a range of from 0.01 g/m$^2$ to 0.5 g/m$^2$, more preferably from 0.01 g/m$^2$ to 0.4 g/m$^2$, and even more preferably from 0.01 g/m$^2$ to 0.3 g/m$^2$. When the coating amount exceeds 0.5 g/m$^2$ or more, sensitivity decreases significantly and it is not preferred.

The compounds expressed by formula (H) of the invention are preferably used in an amount of from $10^{-4}$ mol to 1 mol, more preferably from $10^{-3}$ mol to 0.5 mol, and even more preferably from $1\times10^{-2}$ mol to 0.2 mol, per 1 mol of non-photosensitive silver salt incorporated in the image forming layer.

In the invention, usable methods for incorporating the antifoggant into the photosensitive material are those described above in the method for incorporating the reducing agent. Furthermore, the organic polyhalogen compound is also preferably used in the form of solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to Claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Further, it may be added as a solution having mixed therein other additives such as sensitizing agents, reducing agents, toners, and the like. In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (1) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, and 2002-303951, and the like are preferred.

2) Toner

In the photothermographic material of the present invention, the addition of a toner is preferred. Description on the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

4) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

The non-photosensitive layers of the photothermographic material according to the invention can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

Furthermore, a layer that functions as an optical filter may be provided as (a) or (b) above. An antihalation layer may be provided as (c) or (d) to the photothermographic material. Dyes to prevent irradiation are preferably contained in the non-photosensitive layer on the side having thereon the image forming layer as well as in the image forming layer.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range of from 0.3 $g/m^2$ to 4.0 $g/m^2$, and more preferably, from 0.3 g/m to 2.0 $g/m^2$.

The total amount of the coated binder (including water-soluble polymer and latex polymer) (per 1 $m^2$ of support) in the surface protective layer (per one layer) is preferably in a range of from 0.3 $g/m^2$ to 5.0 $g/m^2$, and more preferably, from 0.3 $g/m^2$ to 2.0 $g/m^2$.

2) Back Layer

The photothermographic material of the invention is preferably a so-called one-side photosensitive material, which comprises at least one layer of a image forming layer containing silver halide emulsion on one side of the support, and a back layer on the other side.

Back layers usable in the invention are described in paragraph Nos. 0128 to 0130 of JP-A No. 11-65021.

The back layer can include an antihalation dye. Dyes which have a light absorption characteristic corresponding to the wavelength region of the imagewise exposure can be selectively used as the antihalation dye. In the case where the light source for exposing is within the visible region of from green to red, the metal phthalocyanine compound represented by formula (PC-1) described above is preferably employed.

In the invention, coloring matters having maximum absorption in the wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 $mg/m^2$ to 1 $g/m^2$, preferably to the back layer which is provided to the opposite side of the support from the image forming layer.

Further, in order to control the basic color tone, it is preferred to use a dye having an absorption peak in a wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming side, or in the back side.

3) Matting Agent

A matting agent is preferably added to the photothermographic material of the invention in order to improve transportability. Description on the matting agent can be found in paragraphs Nos. 0126 to 0127 of JP-A No. 11-65021. The addition amount of the matting agent is preferably in a range from 1 $mg/m^2$ to 400 $mg/m^2$, and more preferably, from 5 $mg/m^2$ to 300 $mg/m^2$, with respect to the coating amount per 1 ml of the photothermographic material.

The shape of the matting agent usable in the invention may fixed form or non-fixed form. Preferred is to use those having fixed form and globular shape. The mean particle diameter is preferably in a range of from 0.5 μm to 10 μm, more preferably, from 1.0 μm to 8.0 μm, and further preferably, from 2.0 μm to 6.0 μm. Furthermore, the particle size distribution of the matting agent is preferably set as such that the variation coefficient may become 50% or lower, more preferably, 40% or lower, and further preferably, 30% or lower. The variation coefficient, herein, is defined by (the standard deviation of particle diameter)/(mean diameter of the particle)×100. Furthermore, it is preferred to use two types of matting agents having low variation coefficient and the ratio of their mean particle diameters being higher than 3, in combination.

The level of matting on the image forming layer surface is not restricted as far as star-dust trouble occurs, but the level of matting of from 30 seconds to 2000 seconds is preferred, particularly preferred, from 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more, when expressed by Beck's smoothness.

In the present invention, a matting agent is preferably contained in an outermost layer, in a layer which can function as an outermost layer, or in a layer nearer to outer surface, and also preferably is contained in a layer which can function as a so-called protective layer.

4) Polymer Latex

The change in size of the photothermographic material can be reduced by adding a polymer latex in the surface protective layer or the back layer of the photothermographic material. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like. Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, based on a total weight of binder.

5) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

6) Hardener

A hardener may be used in each of image forming layer, protective layer, back layer, and the like of the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

7) Surfactant

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoint of capacity in static control, stability of the coated surface state and sliding facility. The fluorocarbon surfactant described in JP-A No. 2001-264110 is most preferred because of high capacity in static control and that it needs small amount to use.

According to the invention, the fluorocarbon surfactant can be used on either side of both sides of the support, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$, more preferably from 0.3 mg/m to 30 mg/m$^2$, and even more preferably from 1 mg/m$^2$ to 10 mg/m$^2$. Especially, the fluorocarbon surfactant described in JP-A No. 2001-264110 is effective, and used preferably in a range of from 0.01 mg/m$^2$ to 10 mg/m$^2$, and more preferably, in a range of from 0.1 mg/m$^2$ to 5 mg/m$^2$.

8) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably in a range of from 3.0 to 50, is preferred viewed from the standpoint of the electric conductivity effect. The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$. The antistatic layer can be laid on either side of the image forming layer side or the backside, it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos.

0040 to 0051 of JP-A No. 11-84573, in U.S. Pat. No. 5,575,957, and in paragraph Nos. 0078 to 0084 of JP-A No. 11-223898.

9) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for an image forming layer or a back layer is conducted on the support.

10) Other Additives

Furthermore, an antioxidant, stabilizing agent, plasticizer, UV absorbent, or film-forming promoting agent may be added to the photothermographic material. Each of the additives is added to either of the image forming layer or the non-photosensitive layer. Reference can be made to WO No. 98/36322, EP No. 803764A1, JP-A Nos. $10^{-186567}$ and $10^{-18568}$, and the like.

11) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which can form image on the photothermographic material without using other sheets such as an image-receiving material).

12) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}\ m^{-2}$ day- or lower at 25° C., more preferably, 10 $mL \cdot atm^{-1}\ m^{-2}\ day^{-1}$ or lower, and even more preferably, 1.0 $mL \cdot atm^{-1}\ m^{-2}\ day^{-1}$ or lower. Preferably, vapor transmittance is 10 $g \cdot atm^{-1}\ m^{-2}\ day^{-1}$ or lower, more preferably, 5 $g \cdot atm^{-1}\ m^{-2}\ day^{-1}$ or lower, and even more preferably, 1 $g \cdot atm^{-1}\ m^{-2}\ day^{-1}$ or lower.

As specific examples of a wrapping material having low oxygen transmittance and/or vapor transmittance, reference can be made to, for instance, the wrapping material described in JP-A Nos. 8-254793 and 2000-206653.

13) Other Applicable Techniques

Techniques which can be used for the photothermographic material of the invention also include those in EP No. 803764A1, EP No. 883022A1, WO No. 98/36322, JP-A Nos. 56-62648, 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-

10229, 2000-47345, 2000-206642, 2000-98530, 2000-98531, 2000-112059, 2000-112060, 2000-112104, 2000-112064, and 2000-171936.

(Image Forming Method)

1) Exposure

The photothermographic material of the invention may be subjected to imagewise exposure by various light sources. The photothermographic material of the present invention is preferably subjected to scanning exposure using a laser beam source. As the laser beam source, He—Ne laser of red through infrared emission, red laser diode, or $Ar^+$, He—Ne, He—Cd laser of blue through green emission, or blue laser diode can be used. Preferred is red to infrared laser diode and the peak wavelength of laser beam is 600 nm to 900 nm, and preferably 620 nm to 850 nm. In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 second to 30 seconds, even more preferably from 5 seconds to 25 seconds, and particularly preferably from 7 seconds to 15 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C.

Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, it is preferred to use the photothermographic materials of the present invention, which exhibit high sensitivity and are hardly influenced by environmental temperature, in combination with the process.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the invention is preferably used for photothermographic materials for use in medical diagnosis, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

Preparation of PET Support

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/$m^2$ was executed, judging from the readings of current and voltage on that occasion. The frequency upon this treatment was 9.6 kHz, and the gap clearance between the electrode and dielectric roll was 1.6 mm.

3) Undercoating

| <Preparations of coating solution for undercoat layer> | |
|---|---|
| Formula (1) (for undercoat layer on the image forming layer side) | |
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethyleneglycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |
| Formula (2) (for first layer on the backside) | |
| Styrene-butadiene copolymer latex (solid content of 40% by weight, styrene/butadiene mass ratio = 68/32) | 130.8 g |
| Sodium salt of 2,4-dichloro-6-hydroxy-S-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |
| Formula (3) (for second layer on the backside) | |
| $SnO_2$/SbO (9/1 by mass ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

<Undercoating>

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 8.4 mL/$m^2$, and dried at 180° C. for 6 minutes. Thus, an undercoated support was produced.

Back Layer

1) Preparation of Coating Solution for Antihalation Layer

<Preparation of Dispersion of Solid Fine Particles (a) of Base Precursor>

2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

<Preparation of Solid Fine Particle Dispersion of Dye>

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of an antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

<Preparation of Coating Solution for Antihalation Layer>

A vessel was kept at 40° C., and thereto were added 37 g of gelatin having an isoelectric point of 6.6 (ABA gelatin, manufactured by Nippi Co., Ltd.), 0.1 g of benzoisothiazolinone, and water to allow gelatin to be dissolved. Additionally, 36 g of the above-mentioned dispersion of the solid fine particles of the dye, 73 g of the above-mentioned dispersion of the solid fine particles (a) of the base precursor, 43 mL of a 3% by weight aqueous solution of sodium polystyrenesulfonate, and 82 g of a 10% by weight liquid of SBR latex (styrene/butadiene/acrylic acid copolymer; mass ratio of the copolymerization of 68.3/28.7/3.0) were admixed to give a coating solution for the antihalation layer in an amount of 773 mL. The pH of the resulting coating solution was 6.3.

2) Preparation of Coating Solution for Back Surface Protective Layer

A vessel was kept at 40° C., and thereto were added 43 g of gelatin having an isoelectric point of 4.8 (PZ gelatin, manufactured by Miyagi Chemical Industry Co., Ltd.), 0.21 g of benzoisothiazolinone, and water to allow gelatin to be dissolved. Additionally, 8.1 mL of a 1 mol/L sodium acetate aqueous solution, 0.93 g of monodispersed fine particles of poly(ethylene glycol dimethacrylate-co-methylmethacrylate) (a mean particle diameter of 7.7 μm, and a standard deviation of particle diameter of 0.3), 5 g of a 10% by weight emulsion of liquid paraffin, 10 g of a 10% by weight emulsion of dipentaerythritol hexaisostearate, 10 mL of a 5% by weight aqueous solution of sodium di(2-ethylhexyl)sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight liquid of ethyl acrylate/acrylic acid copolymer (mass ratio of the copolymerization of 96.4/3.6) latex were admixed. Just prior to the coating, 50 mL of a 4% by weight aqueous solution of N,N-ethylenebis(vinylsulfone acetamide) was admixed to give a coating solution for the back surface protective layer in an amount of 855 mL. The pH of the resulting coating solution was 6.2.

3) Coating of Back Layer

The backside of the undercoated support described above was subjected to simultaneous double coating so that the coating solution for the antihalation layer gave the coating amount of gelatin of 0.54 g/m$^2$, and so that the coating solution for the back surface protective layer gave the coating amount of gelatin of 1.85 g/m$^2$, followed by drying to produce a back layer.

Image Forming Layer, Intermediate Layer, and Surface Protective Layer

1. Preparations of Coating Material

1) Preparation of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate.

Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate(III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate(II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate(II) was deleted; further the precipitation/desalting/water washing/dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $5\times10^{-3}$ mol per 1 mol of silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid 88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less.

The resultant reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resultant development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparations of Solid Dispersions of Development Accelerator-2 and Color-tone-adjusting Agent-1

Also concerning solid dispersions of development accelerator-2 and color-tone-adjusting agent-1, dispersion was executed similar to the development accelerator-1, and thus dispersions of 20% by weight and 15% by weight were respectively obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Dispersion of Compound Represented by Formula (SA)

The compound represented by formula (SA) shown in Table 1 in an amount of 60 g and 150 g of a 10% by weight aqueous solution of modified poly(vinyl alcohol) (manufactured by Kuraray Co., Ltd., Poval MP-203) were added to 90 g of water and thoroughly mixed to give slurry. Zirconia beads having the mean particle diameter of 0.5 mm were provided in an amount of 720 g, and charged in a vessel with the slurry. Dispersion was performed with a dispersing machine (¼G sand grinder mill: manufactured by AIMEX Co., Ltd.) for 15 hours. Thereto was added water to obtain a 20% by weight dispersion. Particles included in the resulting dispersion had a mean particle diameter of from 0.38 μm to 0.45 μm.

9) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

10) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

11) Preparations of Pigment Dispersion and Aqueous Solution of Dye

<<Preparation of Comparative Pigment-1 Dispersion>>

C.I. Pigment Blue 60 in an amount of 64 g and 6.4 g of DEMOL N manufactured by Kao Corporation were added to 250 g of water and thoroughly mixed to give slurry. Zirconia beads having the mean particle diameter of 0.5 mm were provided in an amount of 800 g, and charged in a vessel with the slurry. Dispersion was performed with a dispersing machine (¼G sand grinder mill: manufactured by AIMEX Co., Ltd.) for 25 hours. Thereto was added water to adjust so that the concentration of the pigment became 5% by weight to obtain pigment-1 dispersion. Particles of the pigment included in the resulting pigment dispersion had a mean particle diameter of 0.21 μm.

<<Preparation of Aqueous Solution of Metal Phthalocyanine Dye of the Invention>>

A 5% by weight aqueous solution of metal phthalocyanine dye No. 11 was prepared.

12) Preparation of Polymer Latex Liquid

<<Syntheses of Polymer Latex Having a Monomer Component Represented by Formula (M)>>

Polymer latex Nos. P-1, P-2, and P-4, which are explained in the aforementioned synthetic example-1 to -3, were used.

<<Preparation of SBR Latex Liquid>>

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, and an ionic conductance of 4.80 mS/cm (measurement of the ionic conductance was performed using a conductivity meter CM-30S manufactured by Toa Electronics Ltd. for the latex stock solution (44% by weight) at 25° C.).

2. Preparations of Coating Solution

1) Preparation of Coating Solution for Image Forming Layer

To the dispersion of the silver salt of fatty acid obtained as described above in an amount of 1000 g were serially added water, the dye or the pigment (shown in Table 1), the organic polyhalogen compound-1 dispersion, the organic polyhalogen compound-2 dispersion, the phthalazine compound-1 solution, the polymer latex liquid (shown in Table 1), the reducing agent-1 dispersion, the reducing agent-2 dispersion, the hydrogen bonding compound-1 dispersion, the development accelerator-1 dispersion, the development accelerator-2 dispersion, the color-tone-adjusting agent dispersion, the dispersion of the compound represented by formula (SA), the mercapto compound-1 aqueous solution, the mercapto compound-2 aqueous solution. Just prior to the coating, the mixed emulsion A for coating solution in an amount of 140 g was added thereto, followed by thorough mixing just prior to the coating, which was fed directly to a coating die.

2) Preparations of Coating Solution for Intermediate Layer A

<<Coating Solution A-1 for Intermediate Layer>>

The coating solution A-1 for the intermediate layer contained poly(vinyl alcohol) (PVA) and acrylate latex in a mixing ratio (mass ratio of solid content) of 56/44, as a binder.

To 1000 g of poly(vinyl alcohol) PVA-205 (manufactured by Kuraray Co., Ltd.), 27 mL of a 5% by weight aqueous solution of sodium di(2-ethylhexyl)sulfosuccinate, 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), and 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 mL/m <<Coating Solution A-2 for Intermediate Layer>>

Preparation of coating solution A-2 for intermediate layer was conducted in a similar manner to the process in the preparation of coating solution A-1 for intermediate layer except that the poly(vinyl alcohol) (PVA) and the acrylic latex were not added, but instead, the polymer latex P-4 containing a monomer component represented by formula (M) of the present invention was added to make the same total coating amount thereof.

3) Preparation of Coating Solution for Intermediate Layer B

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

4) Preparation of Coating Solution for Outermost Layer

In 800 mL of water were dissolved 100 g of inert gelatin and 10 mg of benzoisothiazolinone, and thereto were added 40 g of a 10% by weight liquid paraffin emulsion, 40 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl) sulfosuccinate, 4 g of poly(methyl methacrylate) fine particles (mean particle diameter of 0.7 μm, volume weighted mean distribution of 30%), and 21 g of poly(methyl methacrylate) fine particles (mean particle diameter of 3.6 μm, volume weighted mean distribution of 60%), and the obtained mixture was mixed, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

3. Preparations of Photothermographic Material-1 to -11

Reverse surface of the back surface was subjected to simultaneous overlaying coating by a slide bead coating method in order of coating solution for the image forming layer, the coating solution for intermediate layer A, the coating solution for intermediate layer B, and the coating solution for the outermost layer, and thus sample of photothermographic material was produced. The combination of the coating solution for the image forming layer and the coating solution for the intermediate layer A is shown in Table 1. In this method, the temperature of the coating solution was adjusted to 31° C. for the image forming layer and intermediate layer A, to 36° C. for intermediate layer B, and to 37° C. for the outermost layer.

TABLE 1

| | Image Forming Layer | | | | | | |
|---|---|---|---|---|---|---|---|
| | | Compound of Formula (SA) | | Dye | | | |
| Sample No. | Binder | No. | Addition Amount (g/m$^2$) | No. | Addition Amount (g/m$^2$) | Intermediate Layer A | Note |
| 1 | Comparative A (SBR) | — | — | Pigment-1 | 0.045 | A-1 | Comparative |
| 2 | Comparative A (SBR) | SA-26 | 0.025 | Pigment-1 | 0.045 | A-1 | Comparative |
| 3 | P-4 | — | — | Pigment-1 | 0.045 | A-1 | Comparative |
| 4 | P-4 | SA-26 | 0.025 | No. 11 | 0.025 | A-1 | Invention |
| 5 | P-1 | SA-26 | 0.025 | No. 11 | 0.025 | A-1 | Invention |
| 6 | P-2 | SA-26 | 0.025 | No. 11 | 0.025 | A-1 | Invention |
| 7 | P-4 | SA-27 | 0.070 | No. 11 | 0.025 | A-1 | Invention |
| 8 | P-4 | SA-40 | 0.070 | No. 11 | 0.025 | A-1 | Invention |
| 9 | P-1 | SA-26 | 0.025 | No. 11 | 0.025 | A-2 | Invention |
| 10 | P-2 | SA-26 | 0.025 | No. 11 | 0.025 | A-2 | Invention |
| 11 | P-4 | SA-26 | 0.025 | No. 11 | 0.025 | A-2 | Invention |

The coating amount of each compound (g/m$^2$) for the image forming is as follows.

| | |
|---|---|
| Organic silver salt | 4.88 |
| Dye or pigment | (see Table 1) |
| Organic polyhalogen compound-1 | 0.108 |
| Organic polyhalogen compound-2 | 0.225 |
| Phthalazine compound-1 | 0.161 |
| Binder | (see Table 1) |
| Reducing agent-1 | 0.36 |
| Reducing agent-2 | 0.36 |
| Hydrogen bonding compound-1 | 0.522 |
| Development accelerator-1 | 0.010 |
| Development accelerator-2 | 0.007 |
| Color-tone-adjusting agent-1 | 0.006 |
| Compound represented by formula (SA) | (see Table 1) |
| Mercapto compound-1 | 0.0018 |
| Mercapto compound-2 | 0.0108 |
| Silver halide (on the basis of Ag content) | 0.09 |

Conditions for coating and drying are as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the back surface as Beck's smoothness. In addition, measurement of pH of the film surface on the image forming layer side gave the result of 6.0.

Chemical structures of the compounds used in Examples of the invention are shown below.

Spectral sensitizing dye A

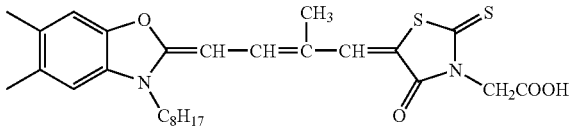

Spectral sensitizing dye B

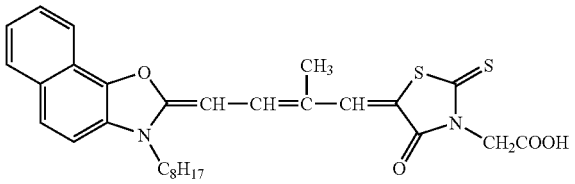

Tellurium sensitizer C

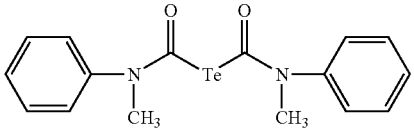

-continued

Base precursor-1

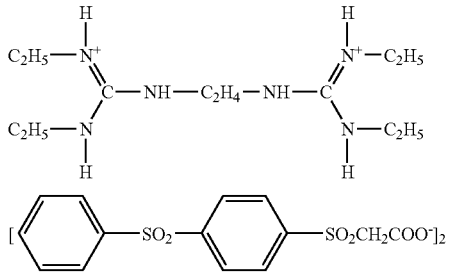

Cyanine dye-1

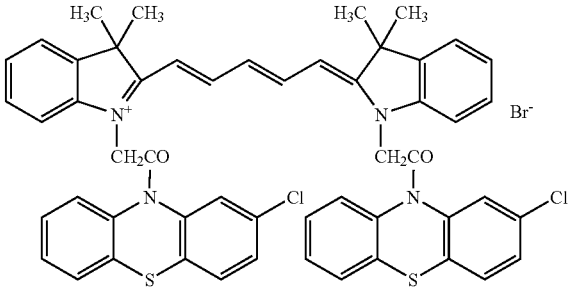

Compound 1 that is one-electron-oxidized to provide a one-electron oxidation product which releases one or more electrons

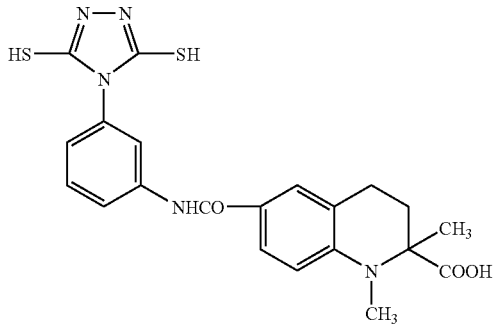

Compound 2 that is one-electron-oxidized to provide a one-electron oxidation product which releases one or more electrons

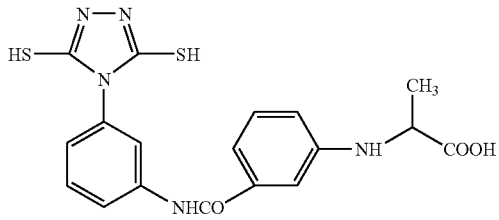

Compound 3 that is one-electron-oxidized to provide a one-electron oxidation product which releases one or more electrons

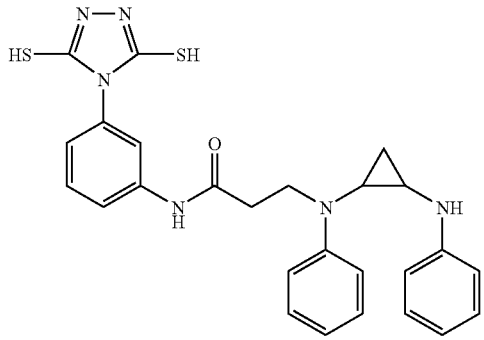

Compound 1 having adsorptive group and reducing group

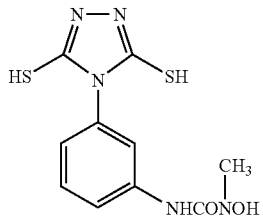

Compound 2 having adsorptive group and reducing group

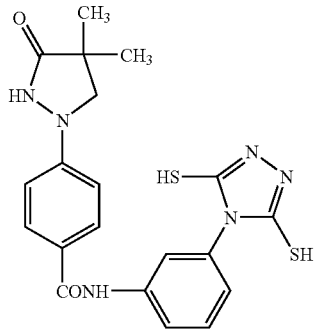

Reducing agent-1

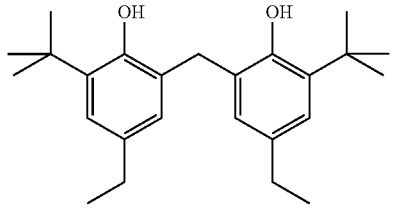

-continued

Reducing agent-2

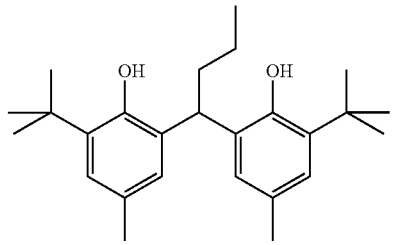

Hydrogen bonding compound-1

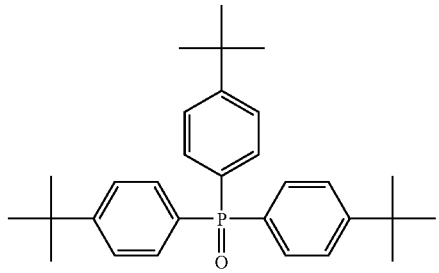

Organic polyhalogen compound-1

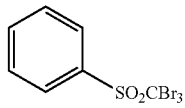

Organic polyhalogen compound-2

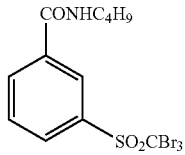

Mercapto compound-1

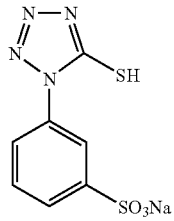

Mercapto compound-2

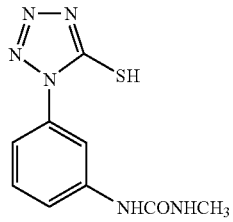

Phthalazine compound-1

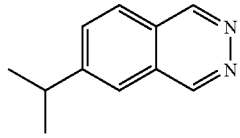

-continued

Development accelerator-1

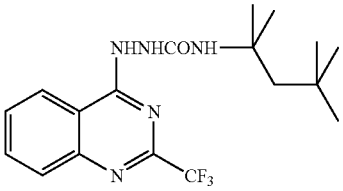

Development accelerator-2

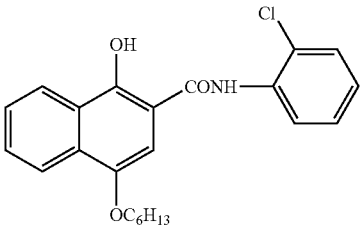

Color-tone-adjusting agent-1

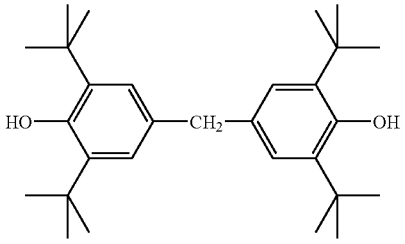

(F-1)

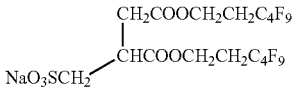

(F-2)

Mixture of

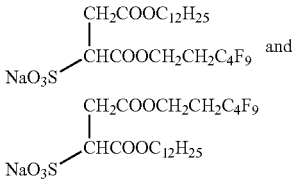

4. Evaluation of Photographic Properties 4-1. Preparation

The obtained sample was cut into a half-cut size (43 cm in length×35 cm in width), and was wrapped with the following packaging material under an environment of 25° C. and 50% RH, and stored for 2 weeks at an ambient temperature.

<<Packaging Material>>

A film laminated with PET 10 μm/PE 12 μm/aluminum foil 9 μm/Ny 15 μm/polyethylene 50 μm containing carbon at 3% by weight:

oxygen permeability at 25° C.: 0.02 mL·atm$^{-1}$ m$^{-2}$ day$^{-1}$;

vapor permeability at 25° C.: 0.10 g·atm$^{-}$μm$^{-2}$ day$^{-1}$.

4-2. Exposure and Thermal Development

To each sample, exposure and thermal development (24 seconds in total with 4 panel heaters set to 112° C.-119° C.-121° C.-121° C.) with Fuji Medical Dry Laser Imager FM-DPL (equipped with 660 nm laser diode having a maximum output of 60 mW (IIIB)) were performed. Evaluation on the obtained image was performed with a densitometer.

4-3. Terms for Evaluation

1) Image Tone

The unexposed portion after thermal development was evaluated sensory by ten persons by the following rankings. The most selected ranking among ten persons was taken as the ranking for the specimen.

A: Low density and highly clear, and favor for transparent photographic materials;

B: Slightly colored, but allowable level for transparent photographic materials;

C: Strongly colored, and not allowable level for transparent photographic materials.

2) Sharpness

The sample was subjected to similar exposure described above, but with a rectangular pattern, and thermal development. The value obtained by dividing the density difference in the rectangular pattern at a spatial frequency of 5 lines/mm by the density difference at 0.01 lines/mm was taken as A. The value A of other samples was represented by the relative value (%) based on the value A obtained for sample No. 1 as the standard, which was regard as the sharpness. The higher is the value, the better is the sharpness.

3) Image Storability

<Rubbing Test by Fingers>

After thermal development, the unexposed portion of the sample was touched by a finger wearing a cotton glove followed by rubbing the surface back and forth thereby for 20 times over 20 cm width. Thereafter, the stain attached on the cotton glove was sensory evaluated.

The higher is the point, the better is the performance.

3 points: No transferred stain is seen;

2 points: Slightly blue tine stain is seen;

1 point: Clearly remarkable blue tine stain is seen.

<Water Dropping Test>

After thermal development, 100 μL of water was dropped on the unexposed portion and wiped out after 10 seconds. The trace wiped out was observed and sensory evaluated. It is preferred that the color tint of the wiped portion is not different from the neighboring portion.

3 points: No color difference between the wiped portion and the neighboring portion is seen;

2 points: The wiped portion is slightly decolored compared with the neighboring portion;

1 point: The wiped portion is decolored, and thereby clear trace is seen.

<Image Storability to Light>

As an evaluation of the image storability with respect to light, the print-out performances were evaluated for samples stored in an accelerated condition.

Thermally developed samples were left for 5 days on a transmission-type lighting viewer (an illumination condition of 7,000 lux) at 25° C. and 60 RH %. Thereafter, changes in image tone before and after the above accelerated test were sensory evaluated over the portion having an image density of 1.0.

◎: Changes in image tone are not observed;

○: Changes in image tone are slightly observed, but practical level for image reading;

Δ: Apparent changes in image tone are seen and laborious levels for image reading;

x: Changes in image tone are big, and difficult for image reading.

4) Results of Evaluation

The obtained results are shown in Table 2.

The samples of the present invention exhibit excellent color tone and high sharpness. Furthermore, even in various accelerated conditions, the samples of the present invention show excellent image storability.

Particularly, sample Nos. 9 to 11 show more excellent performances.

TABLE 2

| Sample No. | Sharpness | Image Tone | Water Dropping Test | Rubbing Test by Fingers | Image Storability to Light | Note |
|---|---|---|---|---|---|---|
| 1 | 97 | A | 3 | 3 | Δ | Comparative |
| 2 | 97 | C | 3 | 3 | Δ | Comparative |
| 3 | 97 | C | 3 | 3 | Δ | Comparative |
| 4 | 99 | A | 2 | 2 | ◎ | Invention |
| 5 | 99 | A | 2 | 2 | ◎ | Invention |
| 6 | 99 | A | 2 | 2 | ◎ | Invention |
| 7 | 99 | A | 2 | 2 | ◎ | Invention |
| 8 | 99 | A | 2 | 2 | ◎ | Invention |
| 9 | 99 | A | 3 | 3 | ◎ | Invention |
| 10 | 99 | A | 3 | 3 | ◎ | Invention |
| 11 | 99 | A | 3 | 3 | ◎ | Invention |

Example 2

Samples were prepared similar to Example 1 except that the dye No. 11 of formula (PC-1) was changed to Nos. 32, 2, and 31, respectively. The prepared samples were evaluated similar to Example 1. As a result, the samples of the present invention exhibit excellent performances similar to Example 1.

What is claimed is:

1. A photothermographic material comprising, on at least one side of a support, an image forming layer comprising at least a photosensitive silver halide, a non-photosensitive organic silver salt, a reducing agent, and a binder, wherein (1) the binder comprises a polymer latex having a monomer component represented by the following formula (M):

$$CH_2{=}CR^{01}{-}CR^{02}{=}CH_2 \qquad \text{Formula (M)}$$

wherein $R^{01}$ and $R^{02}$ each independently represent a hydrogen atom, an alkyl group having 1 to 6 carbon atoms, a halogen atom, or a cyano group; and $R^{01}$ and $R^{02}$ are not simultaneously a hydrogen atom;

(2) the image forming layer comprises a compound represented by the following formula (SA):

Formula (SA)

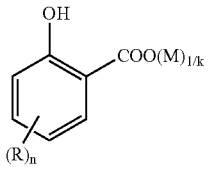

wherein M represents a hydrogen atom or a cation having a valency of k; R represents a substituent; n represents an integer of from 1 to 4; when n is 2 or more, a plurality of R may be the same or different from one another; k represents an integer of 1 or more; and when M is a hydrogen atom, k is 1; and (3) the photothermographic material further comprises a water soluble metal phthalocyanine dye represented by formula (PC-1):

Formula (PC-1)

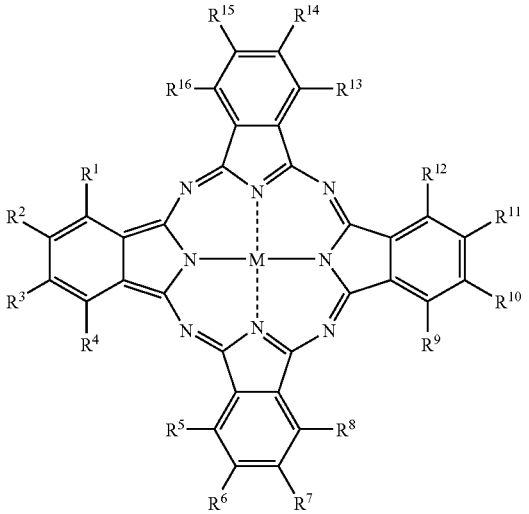

wherein, M represents a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is a group represented by following formula (II):

$$-L^1-R^{17} \qquad \text{Formula (II)}$$

wherein $L^1$ represents a group selected from **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, and **—CO-$CONR_N$—*; ** denotes a bond with a phthalocyanine skeleton at this position, and * denotes a bond with $R^{17}$ at this position; $R_N$ represents a hydrogen atom, an alkyl group, an aryl group, a heterocyclic group, an acyl group, an alkoxycarbonyl group, a carbamoyl group, a sulfonyl group, or a sulfamoyl group; and $R^{17}$ represents an alkyl group, an aryl group, or a heterocyclic group, wherein $R^{17}$ is substituted by a hydrophilic group; and $R^2$, $R^3$, $R^6$, $R^7$, $R^{10}$, $R^{11}$, $R^{14}$, and $R^{15}$ represent a hydrogen atom.

2. The photothermographic material according to claim 1, wherein, in formula (SA), M represents a metallic ion selected from the group consisting of zinc, iron, manganese, cadmium, chromium, cobalt, ruthenium, rhodium, and silver.

3. The photothermographic material according to claim 1, wherein, in formula (SA), the substituent represented by R is one selected from the group consisting of an alkyl group, an alkenyl group, an alkynyl group, an aralkyl group, an aryl group, an amino group, an alkoxy group, an acyl group, an alkoxycarbonyl group, an acyloxy group, an acylamino group, alkoxycarbonylamino group, a sulfonylamino group, a sulfamoyl group, a carbamoyl group, a ureido group, an alkylthio group, a sulfonyl group, a hydroxy group, a mercapto group, a halogen atom, a cyano group, a sulfo group, a carboxy group, a nitro group, and a heterocyclic group.

4. The photothermographic material according to claim 3, wherein, in formula (SA), the substituent represented by R is one selected from the group consisting of an alkyl group, an alkenyl group, an aralkyl group, an amino group, an alkoxy group, an alkylthio group, a hydroxy group, a mercapto group, a halogen atom, a sulfo group, and a carboxy group.

5. The photothermographic material according to claim 1, wherein, in formula (SA), R represents an alkyl group which substitutes at at least one of an ortho-position and a para-position of the OH group of formula (SA).

6. The photothermographic material according to claim 1, wherein, in formula (M), $R^{01}$ represents a hydrogen atom, and $R^{02}$ represents a methyl group.

7. The photothermographic material according to claim 1, wherein the polymer latex is a polymer latex which contains a monomer component having an acid group in a range of from 1% by weight to 20% by weight as a copolymer component.

8. The photothermographic material according to claim 1, wherein four or more from among $R^1$, $R^4$, $R^5$, $R^8$, $R^9$, $R^{12}$, $R^{13}$, and $R^{16}$ in formula (PC-1) are a group represented by formula (II).

9. The photothermographic material according to claim 1, wherein $R^{17}$ is substituted by the hydrophilic group selected from a carboxy group, a sulfo group, a phosphate group, a group having a structure of quaternary salt of nitrogen, a group having a structure of quaternary salt of phosphorus, and a group in which ethylene oxy group units are repeated.

* * * * *